US007325325B2

(12) United States Patent
Gleeson

(10) Patent No.: US 7,325,325 B2
(45) Date of Patent: Feb. 5, 2008

(54) SURFACE GROOVE SYSTEM FOR BUILDING SHEETS

(75) Inventor: James Albert Gleeson, Alta Loma, CA (US)

(73) Assignee: James Hardle International Finance B.V., Amsterdam (NL)

( * ) Notice: Subject to any disclaimer, the term of this patent is extended or adjusted under 35 U.S.C. 154(b) by 0 days.

(21) Appl. No.: 10/889,674

(22) Filed: Jul. 13, 2004

(65) Prior Publication Data

US 2004/0255480 A1 Dec. 23, 2004

Related U.S. Application Data

(63) Continuation of application No. 10/328,073, filed on Dec. 23, 2002, now Pat. No. 6,760,978, which is a continuation of application No. 09/514,785, filed on Feb. 28, 2000, now Pat. No. 6,539,643.

(51) Int. Cl.
*G01B 3/14* (2006.01)
*G01B 3/00* (2006.01)

(52) U.S. Cl. ..... 33/563; 33/1 B; 52/105

(58) Field of Classification Search ..... 33/1 B, 33/1 F, 1 G, 41.1, 562, 563, 565, 566; 52/105; 264/293; 428/43, 409, 537.7, 932
See application file for complete search history.

(56) References Cited

U.S. PATENT DOCUMENTS 369,216 A 8/1887 Temple
815,801 A 3/1906 Depew et al.
1,399,023 A 12/1921 Murray
1,510,497 A 10/1924 Keller
1,634,809 A * 7/1927 Weiss ..... 428/101

(Continued)

FOREIGN PATENT DOCUMENTS

AU B1-60 655-80 3/1981

(Continued)

OTHER PUBLICATIONS

HARDIHOME Lap Siding with the Embossed EZ Line Alignment Aid, Mar. 2000.

(Continued)

*Primary Examiner*—G. Bradley Bennett
(74) *Attorney, Agent, or Firm*—Gardere Wynne Sewell LLP

(57) ABSTRACT

The present invention involves building sheets with a plurality of grooves indented into a surface of the building sheet to provide a guide for cutting the building sheet along the grooves. Preferably, the grooves are arranged in a regularly repeating pattern and are spaced apart by a standard unit of measurement in order for a cutter to accurately size the building sheet to a precise dimension. A simple scoring knife is preferably used to score the sheet along the grooves, without the need for a straight edge, and the sheet is broken by simply bending the sheet of along the score mark. The grooves are preferably provided at a depth into the surface the sheet such that they do not substantially decrease the strength of the sheet or affect off-groove scoring. Thus, a score mark can be made between or across grooves without deflection of the mark into a groove and without breakage of the sheet along a groove when the sheet is bent.

25 Claims, 18 Drawing Sheets

U.S. PATENT DOCUMENTS

| | | | | |
|---|---|---|---|---|
| 1,856,932 | A | 5/1932 | Shaw | |
| 1,856,936 | A | 5/1932 | Turner | |
| 1,871,843 | A | 8/1932 | Ericson | |
| 1,930,024 | A | 10/1933 | Varden | |
| 1,943,663 | A | 1/1934 | Ericson | |
| 1,959,519 | A | 5/1934 | Black | |
| 1,976,984 | A | 10/1934 | Condon et al. | |
| 1,978,519 | A | 10/1934 | Willock et al. | |
| 1,995,393 | A * | 3/1935 | Manske | 52/344 |
| 2,062,149 | A | 11/1936 | Stark et al. | |
| 2,182,372 | A | 12/1939 | Cox et al. | |
| 2,224,351 | A | 12/1940 | Kaye | |
| 2,253,753 | A | 8/1941 | Black | |
| 2,276,170 | A | 3/1942 | Elmendorf | |
| 2,317,634 | A | 4/1943 | Olsen | |
| 2,323,230 | A | 6/1943 | McAvoy | |
| 2,324,325 | A | 7/1943 | Schuh | |
| 2,354,639 | A | 7/1944 | Seymour | |
| 2,400,357 | A | 5/1946 | Krajci | |
| 2,413,794 | A | 1/1947 | Small | |
| 2,447,275 | A | 8/1948 | Price | |
| 2,511,083 | A | 6/1950 | Small | |
| 2,517,122 | A | 8/1950 | Lockwood | |
| 2,624,298 | A | 1/1953 | Farren | |
| 2,694,025 | A | 11/1954 | Slayter et al. | |
| 2,724,872 | A | 11/1955 | Herbes | |
| 2,928,143 | A | 3/1960 | Newton | |
| 3,046,700 | A | 7/1962 | Davenport | |
| 3,047,985 | A | 8/1962 | Murphy | |
| 3,173,229 | A | 3/1965 | Weber | |
| 3,181,662 | A | 5/1965 | Maertzig, Jr. | |
| 3,214,876 | A | 11/1965 | Mattes | |
| 3,284,980 | A | 11/1966 | Dinkel | |
| 3,408,786 | A | 11/1968 | Snyker | |
| 3,416,275 | A | 12/1968 | Van Loghem et al. | |
| 3,527,004 | A | 9/1970 | Sorenson | |
| 3,625,808 | A | 12/1971 | Martin | |
| 3,660,955 | A | 5/1972 | Simon | |
| 3,663,341 | A | 5/1972 | Veneziale, Jr. | |
| 3,663,353 | A | 5/1972 | Long et al. | |
| 3,703,795 | A | 11/1972 | Mattes | |
| 3,729,368 | A | 4/1973 | Ingham et al. | |
| 3,754,365 | A | 8/1973 | Carrick et al. | |
| 3,780,483 | A | 12/1973 | Mattes | |
| 3,782,985 | A | 1/1974 | Gebhardt | |
| 3,797,179 | A | 3/1974 | Jackson | |
| 3,797,190 | A | 3/1974 | Widdowson | |
| 3,804,058 | A | 4/1974 | Messenger | |
| 3,818,668 | A | 6/1974 | Charniga | |
| 3,835,604 | A | 9/1974 | Hoffmann, Jr. | |
| 3,847,633 | A | 11/1974 | Race | |
| 3,866,378 | A | 2/1975 | Kessler | |
| 3,902,911 | A | 9/1975 | Messenger | |
| 3,921,346 | A | 11/1975 | Sauer et al. | |
| 3,928,701 | A | 12/1975 | Roehner | |
| 3,974,024 | A | 8/1976 | Yano et al. | |
| 3,992,845 | A | 11/1976 | Grzesiek et al. | |
| 4,010,587 | A | 3/1977 | Larsen | |
| 4,010,589 | A | 3/1977 | Gross | |
| 4,015,392 | A | 4/1977 | Eaton | |
| 4,034,528 | A | 7/1977 | Sanders et al. | |
| 4,047,355 | A | 9/1977 | Knorr | |
| 4,065,899 | A | 1/1978 | Kirkhuff | |
| 4,070,843 | A | 1/1978 | Leggiere et al. | |
| 4,076,884 | A | 2/1978 | Riley et al. | |
| 4,079,562 | A | 3/1978 | Englert et al. | |
| 4,101,335 | A | 7/1978 | Barrable | |
| 4,102,106 | A | 7/1978 | Golder et al. | |
| 4,104,103 | A | 8/1978 | Tarullo | |
| 4,104,840 | A | 8/1978 | Heintz et al. | |
| 4,110,507 | A | 8/1978 | Colledge | |
| 4,112,647 | A * | 9/1978 | Scheid | 52/481.2 |
| 4,128,696 | A | 12/1978 | Goebel et al. | |
| 4,152,878 | A | 5/1979 | Balinski | |
| 4,166,749 | A | 9/1979 | Sterrett et al. | |
| 4,183,188 | A | 1/1980 | Goldsby | |
| 4,187,658 | A | 2/1980 | Reinwall, Jr. | |
| 4,203,788 | A | 5/1980 | Clear | |
| 4,222,785 | A | 9/1980 | Henderson | |
| 4,231,573 | A | 11/1980 | Kelly | |
| 4,268,317 | A | 5/1981 | Rayl | |
| 4,274,239 | A | 6/1981 | Carroll | |
| 4,292,364 | A | 9/1981 | Wesch et al. | |
| 4,298,647 | A | 11/1981 | Cancio et al. | |
| 4,327,528 | A | 5/1982 | Fritz | |
| 4,337,290 | A | 6/1982 | Kelly et al. | |
| 4,339,489 | A | 7/1982 | Barker et al. | |
| 4,343,127 | A | 8/1982 | Greve et al. | |
| 4,361,616 | A | 11/1982 | Bomers | |
| 4,362,566 | A | 12/1982 | Hinterwaldner | |
| 4,370,166 | A | 1/1983 | Powers et al. | |
| 4,373,955 | A | 2/1983 | Bouchard et al. | |
| 4,379,553 | A | 4/1983 | Kelly | |
| 4,380,564 | A | 4/1983 | Cancio et al. | |
| 4,392,336 | A | 7/1983 | Ganssle | |
| 4,399,643 | A | 8/1983 | Hafner | |
| 4,406,703 | A | 9/1983 | Guthrie et al. | |
| 4,420,351 | A | 12/1983 | Lussi et al. | |
| 4,424,261 | A | 1/1984 | Keeling et al. | |
| 4,429,214 | A | 1/1984 | Brindley et al. | |
| 4,441,944 | A | 4/1984 | Massey | |
| 4,462,835 | A | 7/1984 | Car | |
| 4,463,532 | A * | 8/1984 | Faw | 52/233 |
| 4,465,729 | A | 8/1984 | Cancio et al. | |
| 4,501,830 | A | 2/1985 | Miller et al. | |
| 4,504,320 | A | 3/1985 | Rizer et al. | |
| 4,506,486 | A | 3/1985 | Culpepper, Jr. et al. | |
| 4,514,947 | A | 5/1985 | Grail | |
| 4,553,366 | A | 11/1985 | Guerin | |
| 4,559,894 | A | 12/1985 | Thompson | |
| 4,586,304 | A | 5/1986 | Flamand | |
| 4,592,185 | A | 6/1986 | Lynch et al. | |
| 4,641,469 | A | 2/1987 | Wood | |
| 4,661,398 | A | 4/1987 | Ellis | |
| 4,670,079 | A | 6/1987 | Thompson | |
| 4,673,659 | A | 6/1987 | Wood et al. | |
| 4,698,942 | A | 10/1987 | Swartz | |
| 4,730,398 | A | 3/1988 | Stanton | |
| 4,748,771 | A | 6/1988 | Lehnert et al. | |
| 4,780,141 | A | 10/1988 | Double et al. | |
| 4,789,604 | A | 12/1988 | van der Hoeven | |
| 4,803,105 | A | 2/1989 | Kretow et al. | |
| 4,811,538 | A | 3/1989 | Lehnert et al. | |
| 4,827,621 | A | 5/1989 | Borsuk | |
| 4,841,702 | A | 6/1989 | Huettemann | |
| 4,854,101 | A | 8/1989 | Champagne | |
| 4,858,402 | A * | 8/1989 | Putz | 52/105 |
| 4,870,788 | A * | 10/1989 | Hassan | 52/105 |
| 4,924,644 | A * | 5/1990 | Lewis | 52/105 |
| 4,927,696 | A * | 5/1990 | Berg | 52/105 |
| 4,930,287 | A | 6/1990 | Volk et al. | |
| 4,937,993 | A | 7/1990 | Hitchins | |
| 4,952,631 | A | 8/1990 | McAlpin et al. | |
| 4,955,169 | A | 9/1990 | Shisko | |
| 4,969,302 | A | 11/1990 | Coggan et al. | |
| 4,985,119 | A | 1/1991 | Vinson et al. | |
| 4,995,605 | A | 2/1991 | Conville | |
| 5,017,232 | A | 5/1991 | Miceli | |
| 5,022,207 | A | 6/1991 | Hartnett | |
| 5,045,378 | A | 9/1991 | Libby | |
| 5,047,086 | A | 9/1991 | Hayakawa et al. | |
| 5,077,952 | A | 1/1992 | Moure | |
| 5,080,022 | A | 1/1992 | Carlson | |
| 5,106,557 | A | 4/1992 | Rirsch et al. | |

5,108,679 A 4/1992 Rirsch et al.
5,112,405 A 5/1992 Sanchez
5,114,617 A 5/1992 Smetana
5,115,621 A 5/1992 Kobayashi
5,143,780 A 9/1992 Balassa
5,198,052 A 3/1993 Ali
5,198,275 A 3/1993 Klein
5,210,989 A 5/1993 Jakel
5,224,318 A 7/1993 Kemerer
5,226,274 A 7/1993 Sommerstein
5,229,437 A 7/1993 Knight
5,234,754 A 8/1993 Bache
5,245,811 A 9/1993 Knorr
5,247,773 A 9/1993 Weir
5,252,526 A 10/1993 Whittemore
5,259,872 A 11/1993 Shinozaki et al.
5,268,226 A * 12/1993 Sweeney ..... 428/312.4
5,282,317 A 2/1994 Carter et al.
5,301,484 A 4/1994 Jansson
5,305,568 A 4/1994 Beckerman
5,305,577 A 4/1994 Richards et al.
5,319,909 A 6/1994 Singletery
5,323,581 A 6/1994 Jakel
5,338,349 A * 8/1994 Farrar ..... 428/537.7
5,349,802 A 9/1994 Kariniemi
5,352,288 A 10/1994 Mallow
5,352,290 A 10/1994 Takeshita et al.
5,358,676 A 10/1994 Jennings et al.
5,391,245 A 2/1995 Turner
5,394,672 A 3/1995 Seem
5,395,685 A 3/1995 Seth et al.
5,410,852 A 5/1995 Edgar et al.
5,425,985 A 6/1995 Irvin
5,425,986 A 6/1995 Guyette
5,428,931 A 7/1995 Ragsdale
5,443,603 A 8/1995 Kirkendall
5,461,839 A 10/1995 Beck
5,465,547 A 11/1995 Jakel
5,475,961 A 12/1995 Menchetti
5,477,617 A 12/1995 Guy
5,482,550 A 1/1996 Strait
5,501,050 A 3/1996 Ruel
5,511,316 A 4/1996 Fischer et al.
5,526,627 A 6/1996 Beck
5,545,297 A 8/1996 Andersen et al.
5,561,173 A 10/1996 Dry
5,564,245 A 10/1996 Rademacher
5,580,378 A 12/1996 Shulman
5,580,409 A 12/1996 Andersen et al.
5,603,758 A 2/1997 Schreifels, Jr. et al.
5,617,690 A 4/1997 Gibbs
5,631,097 A 5/1997 Andersen et al.
5,634,314 A 6/1997 Champagne
5,648,144 A 7/1997 Maurer et al.
5,651,227 A 7/1997 Anderson
5,661,939 A 9/1997 Coulis et al.
5,673,489 A * 10/1997 Robell ..... 33/1 B
5,673,529 A 10/1997 Treister et al.
5,675,955 A 10/1997 Champagne
5,697,189 A 12/1997 Miller et al.
5,718,758 A 2/1998 Breslauer
5,718,759 A 2/1998 Stav et al.
5,725,652 A 3/1998 Shulman
5,729,946 A 3/1998 Beck
5,735,092 A 4/1998 Clayton et al.
5,741,844 A * 4/1998 Nass et al. ..... 524/523
5,743,056 A 4/1998 Balla-Goddard et al.
5,749,187 A 5/1998 Umehara et al.
5,768,841 A 6/1998 Swartz et al.
5,791,109 A * 8/1998 Lehnert et al. ..... 52/309.17
5,817,262 A 10/1998 Englert et al.
5,842,280 A * 12/1998 Robell ..... 33/1 B
5,848,508 A 12/1998 Albrecht
5,848,509 A 12/1998 Knapp et al.
5,857,303 A 1/1999 Beck et al.
5,878,543 A 3/1999 Mowery
5,887,403 A 3/1999 Beck
5,891,374 A 4/1999 Shah et al.
5,916,095 A 6/1999 Tamlyn
5,924,213 A * 7/1999 Lee ..... 33/1 B
5,928,777 A 7/1999 Cox et al.
5,935,699 A 8/1999 Barber
5,945,208 A 8/1999 Richards et al.
5,946,876 A 9/1999 Grace, Sr. et al.
5,950,319 A * 9/1999 Harris ..... 52/105
5,968,257 A 10/1999 Ahrens
5,979,135 A 11/1999 Reeves
5,987,838 A 11/1999 Beck
6,000,185 A 12/1999 Beck
6,012,255 A * 1/2000 Smid et al. ..... 52/105
6,029,415 A 2/2000 Culpepper et al.
6,030,447 A 2/2000 Naji et al.
6,046,269 A * 4/2000 Nass et al. ..... 524/523
6,049,987 A * 4/2000 Robell ..... 33/1 B
6,055,787 A 5/2000 Gerhaher
6,063,856 A * 5/2000 Mass ..... 524/523
6,079,175 A 6/2000 Clear
6,084,011 A 7/2000 Lucero et al.
6,093,473 A 7/2000 Min
6,122,876 A 9/2000 Bado et al.
6,122,877 A 9/2000 Hendrickson et al.
6,134,855 A 10/2000 Beck
6,138,430 A 10/2000 Van Acoleyen et al.
6,161,353 A 12/2000 Negola et al.
6,161,354 A 12/2000 Gilbert et al.
6,164,032 A 12/2000 Beck
6,164,214 A 12/2000 Smorgon et al.
6,170,212 B1 1/2001 Suchyna et al.
6,170,214 B1 1/2001 Treister et al.
6,170,215 B1 1/2001 Nasi
6,176,920 B1 1/2001 Murphy et al.
6,195,952 B1 3/2001 Culpepper et al.
6,226,947 B1 5/2001 Bado et al.
6,276,107 B1 8/2001 Waggoner et al.
6,277,189 B1 8/2001 Chugh
6,290,769 B1 9/2001 Carkner
6,295,777 B1 10/2001 Hunter et al.
6,298,626 B2 10/2001 Rudden
6,315,489 B1 11/2001 Watanabe
6,316,087 B1 11/2001 Lehan
6,319,456 B1 11/2001 Gilbert et al.
6,324,807 B1 12/2001 Ishiko
6,346,146 B1 2/2002 Duselis et al.
6,365,081 B1 4/2002 Beck
6,367,208 B1 4/2002 Campbell et al.
6,367,220 B1 4/2002 Krause et al.
6,415,574 B2 7/2002 Beck
6,421,973 B1 * 7/2002 Gregg et al. ..... 52/481.1
6,423,167 B1 7/2002 Palmer et al.
6,425,218 B1 7/2002 Doyon et al.
6,488,792 B2 12/2002 Mathieu
6,514,624 B2 2/2003 Takemoto
6,526,717 B2 3/2003 Waggoner et al.
6,539,643 B1 * 4/2003 Gleeson ..... 33/563
6,550,203 B1 4/2003 Little
6,550,210 B1 4/2003 Levine et al.
6,551,694 B1 4/2003 Imamichi et al.
6,562,444 B1 5/2003 Gleeson et al.
6,610,358 B1 8/2003 Williams et al.
6,676,745 B2 1/2004 Merkley et al.
6,679,011 B2 1/2004 Beck et al.
6,689,451 B1 2/2004 Peng et al.
6,737,008 B2 5/2004 Gilbert et al.
6,760,978 B2 * 7/2004 Gleeson ..... 33/563
6,901,713 B2 6/2005 Axsom
6,913,819 B2 7/2005 Wallner

| | | | |
|---|---|---|---|
| 6,941,720 | B2 | 9/2005 | DeFord et al. |
| 2002/0100249 | A1 | 8/2002 | Peng et al. |
| 2002/0139082 | A1 | 10/2002 | DeFord et al. |
| 2003/0046891 | A1 | 3/2003 | Colada et al. |
| 2003/0054123 | A1 | 3/2003 | Black et al. |
| 2003/0056458 | A1 | 3/2003 | Black et al. |
| 2003/0200721 | A1 | 10/2003 | Gleeson et al. |
| 2004/0103610 | A1 | 6/2004 | Axsom |
| 2005/0210790 | A1 | 9/2005 | Wallner |

FOREIGN PATENT DOCUMENTS

| | | | |
|---|---|---|---|
| AU | 84015-82 | | 12/1983 |
| AU | 46878/89 | | 7/1990 |
| CA | 1084230 | | 8/1980 |
| CA | 2313456 | | 6/1999 |
| CH | 684285 | | 8/1994 |
| CN | 1081168 | A | 1/1994 |
| CN | 2281378 | Y | 5/1998 |
| DE | 4004103 | | 2/1990 |
| DE | 19858342 | C1 | 12/1998 |
| EP | 0173553 | A | 3/1986 |
| EP | 0222339 | A1 | 5/1987 |
| EP | 0347092 | A | 12/1989 |
| EP | 0220073 | B1 | 5/1991 |
| EP | 0 482 810 | | 4/1992 |
| EP | 0484283 | A1 | 5/1992 |
| FR | 990242 | | 6/1951 |
| FR | 2562591 | | 10/1985 |
| FR | 2624870 | | 6/1989 |
| GB | 119182 | | 9/1918 |
| GB | 558584 | | 1/1944 |
| GB | 1512084 | | 5/1978 |
| GB | 2041384 | | 9/1980 |
| GB | 2078611 | | 1/1982 |
| GB | 2067622 | | 7/1982 |
| GB | 2148871 | | 6/1985 |
| GB | 2252987 | | 8/1992 |
| JP | 49-116445 | | 2/1973 |
| JP | 49-46761 | | 12/1974 |
| JP | 51-23229 | | 6/1976 |
| JP | 52051719 | | 4/1977 |
| JP | 52052429 | | 4/1977 |
| JP | 54-123129 | | 9/1979 |
| JP | 56-130832 | | 3/1980 |
| JP | 55-116684 | | 9/1980 |
| JP | 56-048413 | | 5/1981 |
| JP | 56-41881 | | 9/1982 |
| JP | 57-156541 | | 9/1982 |
| JP | 60-242242 | | 2/1985 |
| JP | 60-105715 | | 7/1985 |
| JP | 61-68967 | | 9/1986 |
| JP | 63-31426 | | 6/1988 |
| JP | 63-19636 | | 9/1988 |
| JP | 63257631 | A2 | 10/1988 |
| JP | 63-47229 | | 12/1988 |
| JP | 64-50541 | | 3/1989 |
| JP | 02192447 | A2 | 7/1990 |
| JP | 02-236350 | | 9/1990 |
| JP | 3-4654 | | 2/1991 |
| JP | 3-63641 | | 6/1991 |
| JP | 3-66338 | | 6/1991 |
| JP | 04089340 | A2 | 3/1992 |
| JP | 04295072 | A2 | 10/1992 |
| JP | 04300232 | A2 | 10/1992 |
| JP | 5-1532 | | 1/1993 |
| JP | 044323/93 | | 2/1993 |
| JP | 5-42192 | | 10/1993 |
| JP | 06-017621 | | 1/1994 |
| JP | 6023889 | | 2/1994 |
| JP | 6-28563 | | 3/1994 |
| JP | 06-080264 | | 3/1994 |
| JP | 08012450 | A2 | 1/1996 |
| JP | 08-175859 | | 7/1996 |
| JP | 08217561 | A2 | 8/1996 |
| JP | 2538120 | | 3/1997 |
| JP | 09-123340 | | 5/1997 |
| JP | 09-193120 | | 7/1997 |
| JP | 09-296560 | | 11/1997 |
| JP | 10-121693 | | 5/1998 |
| JP | 10-245925 | | 9/1998 |
| JP | 11-210203 | | 8/1999 |
| JP | 11-217918 | | 8/1999 |
| JP | 11-511110 | | 9/1999 |
| JP | 11-280172 | | 10/1999 |
| JP | 2000-043196 | | 2/2000 |
| JP | 2000-110272 | | 4/2000 |
| JP | 2000-302522 | A2 | 10/2000 |
| NO | 9901129 | A | 9/2000 |
| NZ | 210395 | | 11/1984 |
| NZ | 221389 | | 12/1991 |
| NZ | 230209 | | 12/1993 |
| NZ | 247463 | | 12/1993 |
| NZ | 520286 | | 3/2004 |
| PL | P-339671 | | 1/2001 |
| RU | 1606633 | | 11/1990 |
| TW | 282 800 | | 8/1996 |
| WO | WO 92/17657 | | 10/1992 |
| WO | WO 95/26450 | | 10/1995 |
| WO | WO 97/07968 | | 3/1997 |
| WO | WO 97/08111 | | 3/1997 |
| WO | WO 97/08401 | | 3/1997 |
| WO | WO 97/23696 | | 3/1997 |
| WO | WO 98/10151 | | 3/1998 |
| WO | WO 98/45222 | | 10/1998 |
| WO | WO 99/13185 | | 3/1999 |
| WO | WO 99/31158 | | 6/1999 |
| WO | WO 00-08271 | | 2/2000 |
| WO | WO 00/21901 | | 4/2000 |
| WO | WO 00/55446 | | 9/2000 |
| WO | WO 00-63506 | | 10/2000 |
| WO | WO 01/16048 | A1 | 3/2001 |
| WO | WO 01-26894 | A1 | 4/2001 |
| WO | WO 01/36191 | | 5/2001 |
| WO | WO 01/65021 | | 9/2001 |
| WO | WO 02/28795 | A | 4/2002 |
| WO | WO 02/28796 | A | 4/2002 |
| WO | WO 02/32830 | | 4/2002 |
| WO | WO 02/055806 | A1 | 7/2002 |
| WO | WO 02/081839 | A1 | 10/2002 |
| WO | WO 02/081840 | A1 | 10/2002 |
| WO | WO 02/081841 | A1 | 10/2002 |
| WO | WO 02/081842 | A1 | 10/2002 |

OTHER PUBLICATIONS

Kuroki et al., "Cement-Bonded Board Industry and Market in Japan and New Technology Developments", 1995.

Letter from Sargent & Krahn dated Jan. 31, 2005 reporting First Substantive Report for Chilean Patent Application No. 655-2002 dated Mar. 4, 2002, which claims priority to U.S. Appl. No. 60/281,195, filed Apr. 3, 2001.

Letter from Sargent & Krahn dated Apr. 1, 2005 reporting First Substantive Report for Chilean Patent Application No. 653-2002 dated Mar. 4, 2002, which claims priority to U.S. Appl. No. 60/281,195, filed Apr. 3, 2001.

James Hardie article, "External Wall Cladding," Oct. 1990 (2 pgs).

James Hardie article, "Primeline Weatherboards," Oct. 1996 (8 pgs).

BGC Fibre Cement "Ceramic Tile Floor Underlay" Apr. 2002, (7 pgs.).

Gypsum Association Manual, 14th Edition 1994, p. 33-34.

J.E. Mark, Applied Polymer Science 21st Century, pp. 209-222 (Clara D. Craver and Charles E. Carraher, Jr. ed., Elsevier 2000).

Hawley's Condensed Chemical Dictionary, Fourteenth Edition, Revised by Richard J. Lewis, Sr., published by John Wiley & Sons, Inc. pp. 447, 624, 903-904.

Database WPI, Section Ch, Week 197723, Derwent Publications Ltd., London, GB, XP002159268.
Database WPI, Section Ch, Week 197723, Derwent Publications Ltd., London, GB, XP002159269.
PCA (Portland Cement Assoc) article: "Concrete Homes—Fiber Cement Siding" (3 pgs).
Notification of First Office Action for Chinese Patent Application No. 00815911.4 dated Sep. 24, 2004.
Notification of First Office Action for Chinese Patent Application No. 02811074.9 dated Feb. 4, 2005.
Notification of First Office Action for Chinese Patent Application No. 02811237.7 dated Mar. 18, 2005.
Notification of First Office Action for Chinese Patent Application No. 02811168.0 dated Mar. 18, 2005.
Chilean patent application 170-97 (S. Ind. Pizarreno, Dec. 5, 1997).
Chilean patent application 2673-97 (S. Ind. Pizarreno, Jan. 30, 1997).
Letter from Sargent & Krahn dated Apr. 11, 2005 reporting First Substantive Report for Chilean Patent Application No. 656-2002 dated Mar. 4, 2002, which claims priority to U.S. Appl. No. 60/281,195, filed Apr. 3, 2001.
International Search Report for PCT/US 02/10760 dated Aug. 5, 2002.
International Search Report for PCT/US 02/10610 dated Aug. 5, 2002.
International Search Report for PCT/US 02/10608 dated Aug. 5, 2002.
International Search Report for PCT/US 02/10609 dated Aug. 7, 2002.
International Search Report for PCT/US2004/019980 dated Jun. 21, 2004.
Examination Report for European Patent Application No. 00980518.5.
Notice of Opposition of Chilean patent application No. 653-2002.
Notice of Opposition of Chilean patent application No. 655-2002.
Notice of Opposition of Chilean patent application No. 656-2002.
Notice of Opposition of Chilean patent application No. 654-2002.

* cited by examiner

SURFACE GROOVE SYSTEM FOR BUILDING SHEETS

RELATED APPLICATIONS

This application is a continuation of U.S. patent application having Ser. No. 10/328,073 and filed on Dec. 23, 2002, now U.S. Pat. No. 6,760,978, which is a continuation of U.S. patent application Ser. No. 09/514,785 and filed on Feb. 28, 2000 now U.S. Pat. No. 6,539,643, the disclosures of which are hereby expressly incorporated herein by reference.

BACKGROUND OF THE INVENTION

1. Field of the Invention

This invention relates to a method, apparatus and article enabling quickly and more easily cutting, breaking and installing building sheets, and more particularly, to building sheets having a surface groove system to guide a cutter without the need for a straight edge.

2. Description of the Related Art

Building sheets made of fiber cement and other materials are often used as backerboards for floors, countertops, walls, etc. For instance, backerboards for ceramic tiles are used for countertops to provide the water resistant, relatively rigid, dimensionally-stable foundation over which the tile is bonded during the installation. Conventionally, the backerboard is laid over an exterior grade sheet of plywood ½ to 1 inch thick and adhered thereto using an adhesive such as a dry-set portland cement mortar or latex-modified portland cement mortar thinset. The backerboard is also fastened to the plywood subfloor using nails or screws. Once the backerboard is in place, ceramic tile is laid over the backerboard and adhered thereto using a modified thinset or other suitable tile adhesives. Backerboards are installed in a similar manner for a number of other applications, such as tile backer for floor installations and wallboard installations where the material is installed direct to stud or exterior sheathing or paneling applications.

For these and other applications, building sheets must generally be sized and cut to an appropriate dimension for installation. For instance, tile backerboards must be appropriately sized and cut before placement over plywood subfloor. This can be a time consuming and labor-intensive process, requiring a number of different tools and great precision to size and cut a board to the desired dimension. Cutting of a backerboard typically requires using a straight edge and scoring knife to score the backerboard on one side, and then snapping the backerboard up against the edge of the straight edge to break the board along the score mark. It is often difficult (particularly for long cuts) to hold the straight edge in a fixed relationship to the material with one hand, and perform the scoring or cutting with the other hand. Resultant slippage can reduce the accuracy of the resulting cut. Alternatively, a circular saw with a carbide tipped blade or shears have also been used to cut backerboards.

To assist in determining a desired cut location, backerboards have been known to contain marker locations, for example markers 6 inches apart marked in ink, to indicate fastening locations for nails or drills. These markers can also provide a visual aid to enable a cutter to more easily locate a desired cutting location. U.S. Pat. No. 5,673,489 to Robell describes a gridded measurement system for construction materials such as wallboards wherein a plurality of horizontal and vertical unit measurement markings are positioned around the perimeter of the construction material surface to provide quick dimensional reference for sizing of the construction material. The construction material surface is filled with horizontal and vertical grid markings between the numbered unit measurement markings.

Construction boards with markings as described above, though generally assisting in visualizing cut locations, still do not significantly decrease the time and labor for installation. This is due in part to the fact that boards with markings still require the use of a straight edge or other tool to guide a cut mark across the board.

Accordingly, what is needed is a method and apparatus for reducing the time and improving the efficiency of installing building sheets such as backerboards, and more particularly, a building sheet that accomplishes some or all of these and other needs.

SUMMARY OF THE INVENTION

Briefly stated, the preferred embodiments of the present invention describe building sheets with a plurality of grooves indented into a surface of the building sheet to provide a guide for cutting the building sheet along the grooves. Preferably, the grooves are arranged in a regularly repeating pattern and are spaced apart by a standard unit of measurement in order for a cutter to accurately size the building sheet to a precise dimension. A simple carbide-tip scoring knife, such as supplied by Superior Featherweight Tools Company, Industry, Calif., is preferably used to score the sheet along the grooves, without the need for a straight edge, and the sheet is broken by simply bending the sheet along the score mark. The grooves are preferably provided at a depth into the surface of the sheet such that they do not substantially decrease the strength of the sheet or affect off-groove scoring and snapping. The design of the grooves is such that a score mark can be made between, across, or on a diagonal to the grooves and the material snaps so that the line of breakage follows the score mark and not the line of the nearby grooves.

Other indentations may also be provided into the surface of the building sheet. For instance, in one preferred embodiment, fastener indent areas may be provided at regularly spaced increments to receive nails or other fasteners. These indent areas allow the fastener to be inserted through the sheet with the head of the fastener being nailed or screwed flat or below the surface of the sheet. Edge markers may be indented along the edges of the sheet to further indicate desired measurement increments. Optionally, edges may be grooved, flat or set down. Set down areas at the edges of the sheet provide an area for nails, adhesives and joining tape to be placed onto the sheet without protruding above the surface of the sheet.

Thus, in one aspect of the present invention, a building sheet is provided. The sheet comprises a substantially flat board having a front surface and a back surface and a thickness defined there between. At least one surface groove is formed into one of the front surface and back surface. The groove defines a line of cutting adapted to guide a knifepoint across at least a portion of the board.

In another aspect of the present invention, the building sheet comprises a substantially flat board having a top edge, a bottom edge and opposing side edges, and opposing faces defined between the edges of the board. A surface grid system is provided on at least one of the opposing faces, the surface grid system including a plurality of cutting grooves indented into the face of the board that extend substantially across the face of the board in straight lines. The grooves are arranged in parallel and perpendicular to the edges of the board or to one another, and are capable of receiving a score mark for cutting and breaking the board.

In another aspect of the present invention, the building sheet comprises a substantially flat board having a front surface and a back surface and a top edge, bottom edge and opposing side edges. The board has a thickness defined between the front surface and back surface. At least one set down area is indented into one of said front surface and back surface. The at least one set down area is adapted to receive a fastener therein. In one embodiment, the at least one set down area includes a plurality of fastener guides arranged in a regularly repeating pattern across the surface of the board. In another embodiment, the at least one set down area includes an edge set down area adapted to receive a reinforcing tape therein.

In another aspect of the present invention, a building sheet construction is provided. This construction comprises a foundation layer having a front surface and a back surface, and a substantially flat board having a front surface and a back surface overlying the foundation layer. The back surface of the board overlies the front surface of the foundation layer. The front surface of the board has at least one pre-formed indentation into the surface thereof. At least one fastener having a head extends through the board into the foundation layer, wherein the fastener extends through an indentation such that the head of the fastener lies at or below the front surface of the foundation layer.

In another aspect of the present invention, a building sheet comprises a substantially flat board having opposing surfaces, and a plurality of indentations provided into at least one of said opposing surfaces. The board has a bending strength that has been reduced by no more than about 20%, more preferably about 10%, and even more preferably about 5% below than the bending strength of the same board without the plurality of indentations.

In another aspect of the present invention, a method of cutting a building sheet is provided. The building sheet is scored at a desired location on a surface of the sheet, the sheet having at least one cutting groove formed into the sheet. The scoring of the sheet forms a score mark in the surface. The sheet is bent along the score mark to break the sheet. In one embodiment, the sheet is scored such that the score mark lies within and substantially along a cutting groove. In another embodiment, the sheet is scored such that the score mark lies substantially outside of a cutting groove.

DETAILED DESCRIPTION OF THE PREFERRED EMBODIMENTS

Certain preferred embodiments of the present invention relate to a building sheet having a plurality of surface grooves provided therein that aid in cutting the sheet without the need for a straight edge. The building sheet is more preferably a backerboard for flooring or other surface treatments such as ceramic tile, countertops, walls and the like. However, it will be appreciated that the principles of the present invention may be applied to other types of building sheets, including, but not limited to, interior wallboard, wall panels, exterior sheathing, panel flooring, decking, ceiling panels, soffit panels, facade panels and general building and furniture flat panels.

Figure 1:
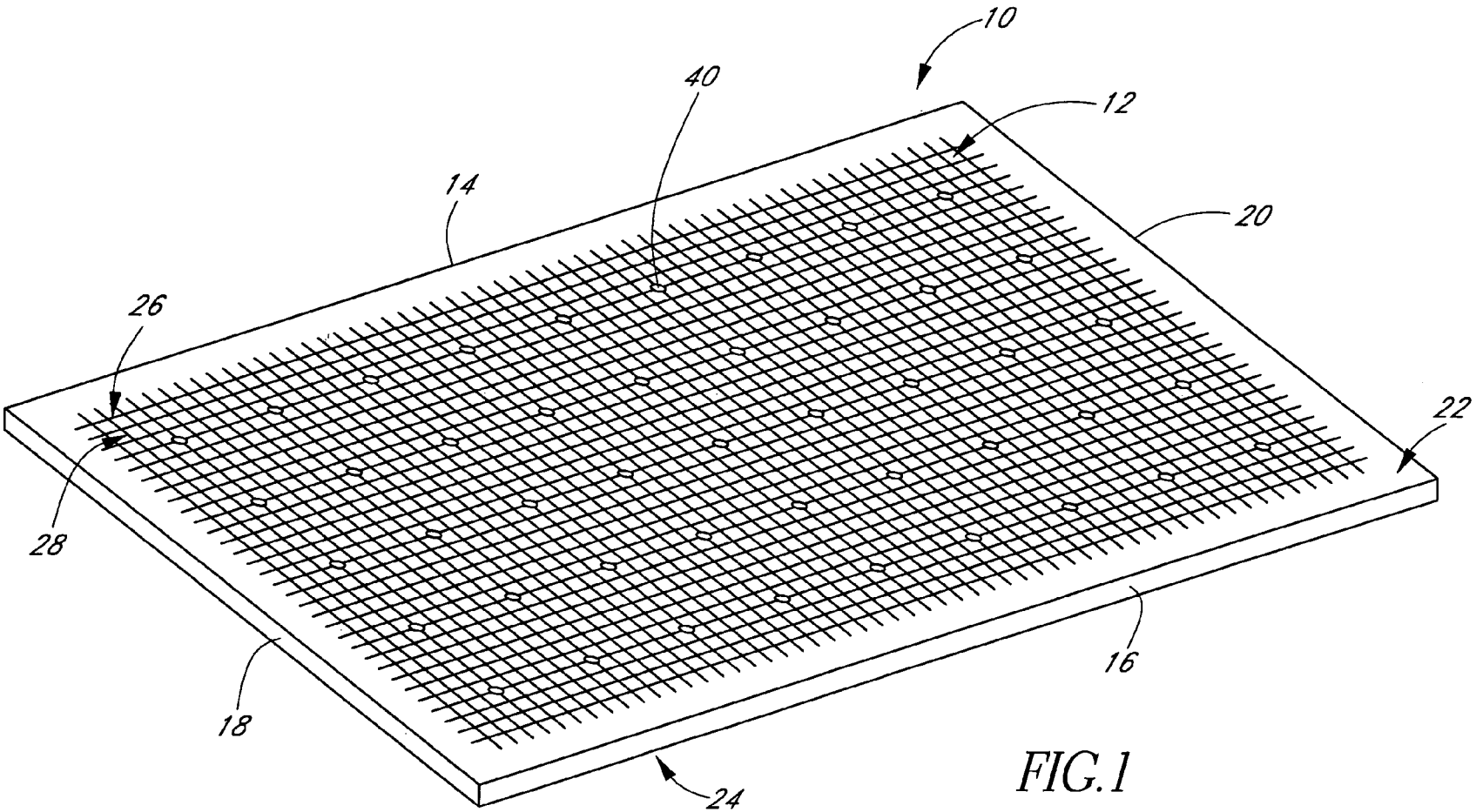
FIG. 1 is a perspective view of a backerboard having a plurality of intersecting surface grooves.

FIG. 1 illustrates one exemplary embodiment of a backerboard 10 having a plurality of surface grooves 12 provided thereon. The backerboard 10, before being sized and cut to its desired dimension for installation, is preferably a substantially flat, rectangular board having a top edge 14, a bottom edge 16, side edges 18 and 20, a front surface or face 22 and a back surface or face 24. The backerboard of the preferred embodiment is made of a fiber cement material, such as James Hardie Building Products' Hardibacker®, although other materials, such as plywood, hardboard, oriented strand board (OSB), engineered wood, fiber-matte-reinforced cement substrate sheets, cement boards, gypsum based wallboards and cement-bonded particle boards may also be used.

In one embodiment, the fiber cement material is about 20% to 60% Portland cement, about 20% to 70% ground silica sand, about 0% to 12% cellulose fiber, and about 0% to 6% select additives such as mineral oxides, mineral hydroxides and water. Platelet or fibrous additives, such as, for example, wollastonite, mica, glass fiber or mineral fiber, may be added to improve the thermal stability of the fiber cement. The dry density fiber cement sheet is typically about 0.8 g/cm$^3$ (low density) to about 1.3 g/cm$^3$ (medium density) to about 1.8 g/cm$^3$ or more (high density). Density can be modified by addition of density modifiers such as unexpanded or expanded vermiculite, perlite, clay, shale or low bulk density (about 0.06 to 0.7 g/cm$^3$) calcium silicate hydrates. The moisture content of the fiber cement is preferably from about 1% to about 30%. The art of manufacturing cellulose fiber reinforced cement is described in the Australian patent AU 515151.

Typical backerboard sizes in accordance with the preferred embodiments of the present invention are 3'×5', 4'×4' and 4'×8' having thicknesses of preferably 3" or greater. Other nominal thicknesses of ⅜, 7/16, ½ and ⅝ inch may also be used.

The grooves 12 illustrated in FIG. 1 are preferably provided only on the front surface 22 of the backerboard 10, although it will be appreciated that grooves may be provided only on the back surface 24, or on both surfaces 22 and 24. Grooves may be desired for the back surface, for instance, when the front surface of the building sheet needs to be flat for painting or other applications. The grooves 12 illustrated in FIG. 1 preferably include two sets of grooves, namely a first set 26 that runs parallel to the top and bottom edges 14 and 16, and a second set 28 that runs parallel to the side edges 18 and 20 and perpendicular to the first set 26. It will be appreciated that grooves may be provided at different angles on the backerboard, and may run in single or multiple directions.

The grooves 12 preferably run in straight lines across the face of the board. In one embodiment, the grooves stop short of the edges of the board, as shown in FIG. 1. For example, a board that is 3'×5' in size may have grooves that extend to about 1½ inches from the edges of the sheet. This distance is preferably short enough to allow a freehand cut from the end of the groove to the edge of the sheet. By stopping the grooves short of the edge of the sheet, these edge areas without groove indentations may be used for joining adjacent sheets with adhesive and tape, as described below. These edge areas also may be used for placement of increment identifiers as described below.

Figure 2:
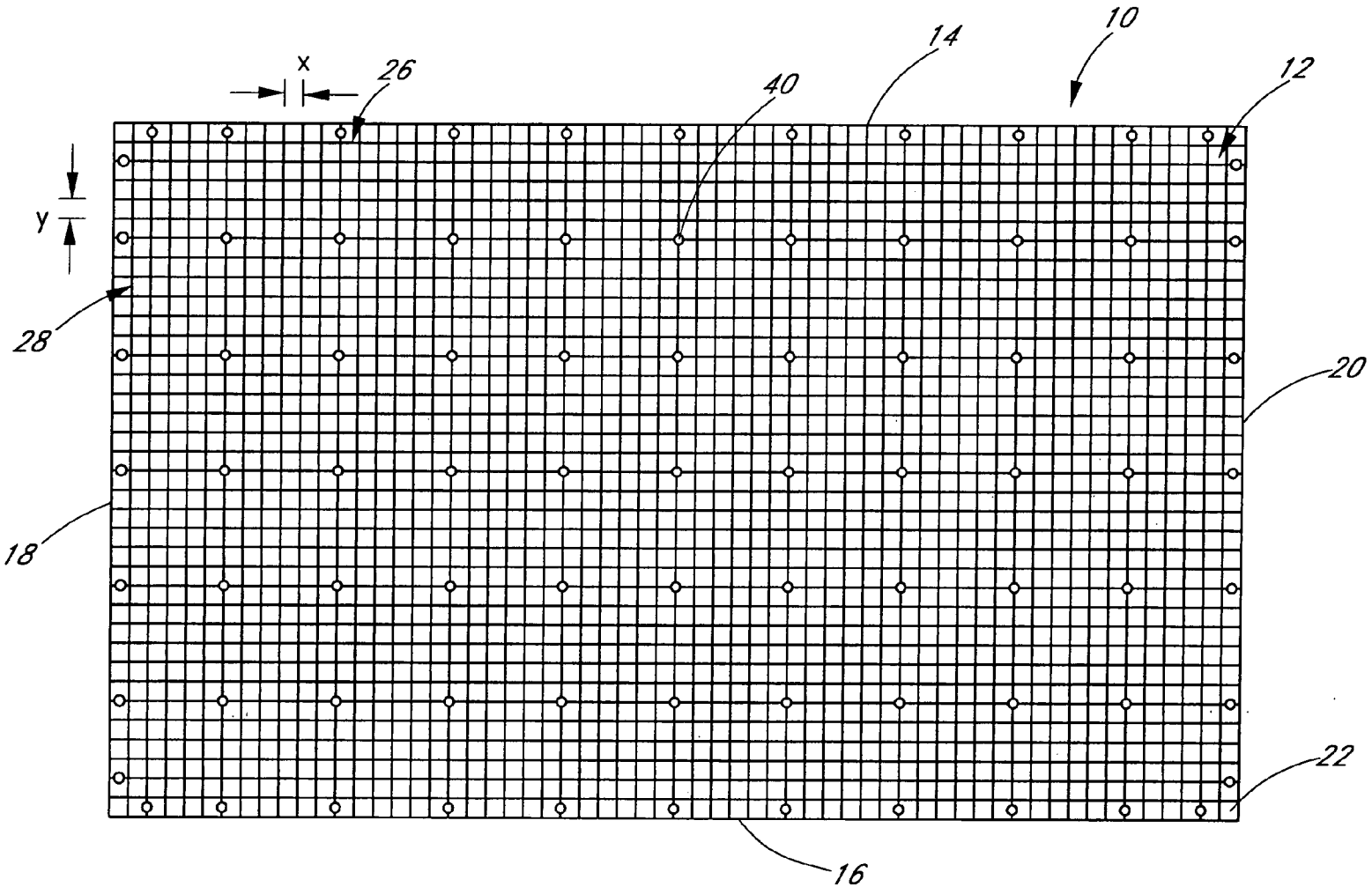
FIG. 2 is a top elevation view of a 3'×5' backerboard having a plurality of intersecting surface grooves with a 1" spacing.
Figure 3:
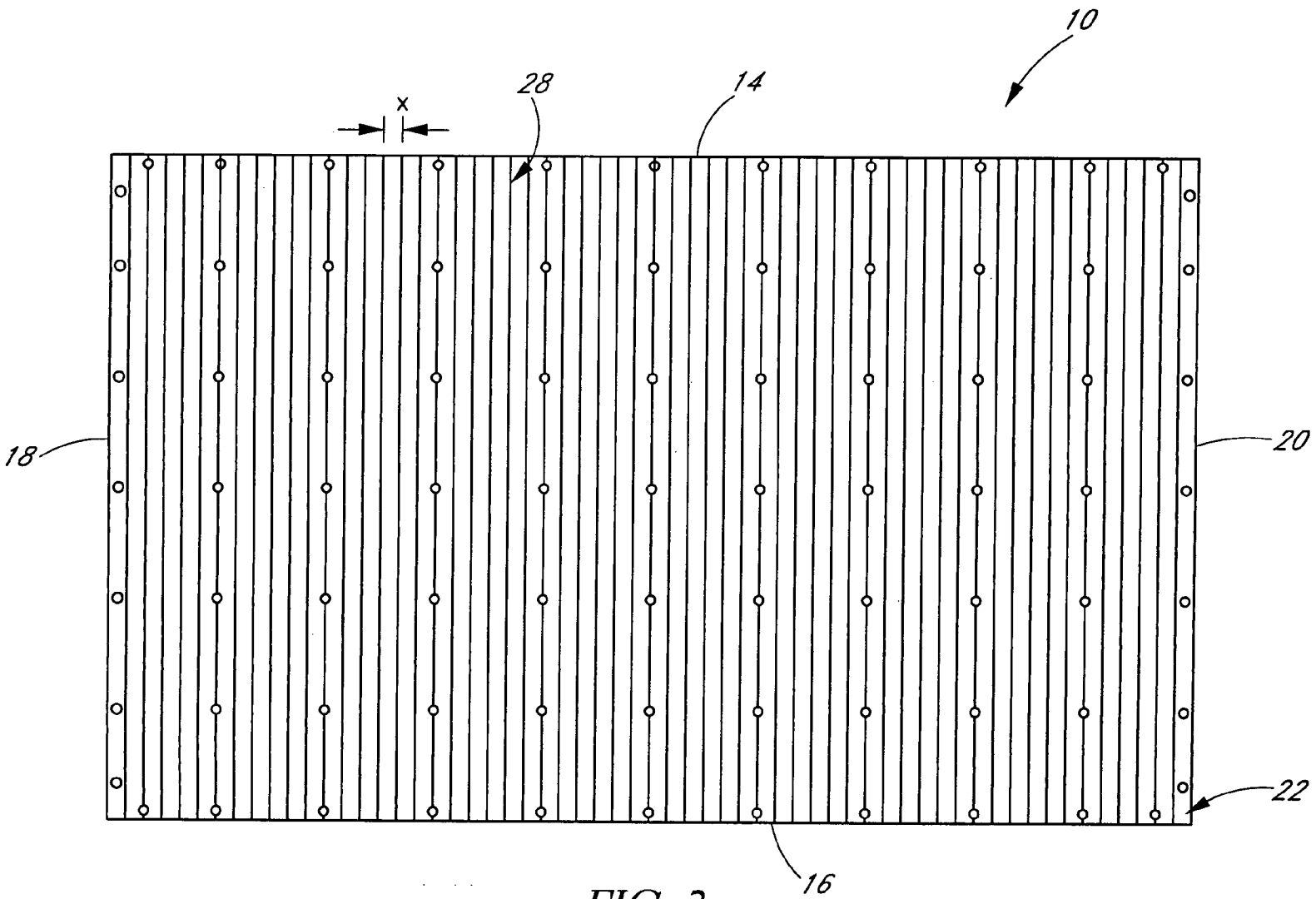
FIG. 3 is a top elevation view of a 3'×5' backerboard having a plurality of parallel surface grooves with a 1" spacing.

FIGS. 2 and 3 illustrate backerboards 10 that are preferably 3'×5' in size having a plurality of grooves 12 indented therein. FIG. 2 illustrates a board having both horizontal grooves 26 and vertical grooves 28 as in FIG. 1, except that the grooves in FIG. 2 extend all the way to the edges of the board. FIG. 3 illustrates an embodiment in which only vertical grooves 28 are provided across the board.

The grooves 12 in the embodiments above are preferably arranged in a regularly repeating pattern, such that there is uniform spacing between the grooves of the first set 26, and there is uniform spacing between the grooves of the second set 28. As illustrated in FIG. 2, when the groove spacing is preferably uniform, each groove of the first set 26 is set apart by a distance y, while each groove of the second set 28 is set apart by a distance x. More preferably, the distance x is equal to the distance y. The distances x and y are preferably selected to correspond with a standard measuring unit to enable a quick determination as to the size of the board along each of the grooves. For instance, in the embodiment of FIG. 2, the spacing x, y between the grooves is 1 inch. Similarly, for a board 10 as illustrated in FIG. 3, a standard spacing between the vertical grooves 28 may also be 1 inch. It will be appreciated that the grooves may be placed closer or farther together as desired. Grooves placed closer together enable greater accuracy in cutting and reduces the time taken to measure, mark and cut the sheet. Thus, smaller increments as low as 1/32" of an inch or less and as large as 12" or more may also be used. For instance, FIG. 4, described in further detail below, illustrates a 3'×5' backerboard 10 having intersecting surface grooves with a 3" spacing.

The depth and shape of the grooves 12 are selected such that the grooves are capable of guiding a knifepoint, pencil or marker in a straight line along a groove. However, the depth of the grooves is preferably not so deep such that, when a diagonal score mark is made in the board surface across the groove lines, the board when bent breaks along a groove line instead of along the score mark. The depth of the grooves 12 is also preferably not so deep such that a diagonal score line across the groove lines causes a knifepoint to unintentionally track into the line of the groove. Moreover, the depth of the grooves is preferably not so deep such that the grooves substantially decrease the strength of the backerboard. For any particular board material and thickness, such a groove depth can be readily ascertained by simple empirical means, as described in more detail below.

Accordingly, in one embodiment the grooves 12 are preferably between about 0.001 inches and ¼ the thickness of the sheet. More preferably, for a backerboard having a thickness of 3", the grooves 12 have a depth of about 0.01 to 0.06 inches. Even more preferably, the groove depth is preferably less than about 25% of the thickness of the board, more preferably less than about 15% of the thickness of the board.

Figure 5A:
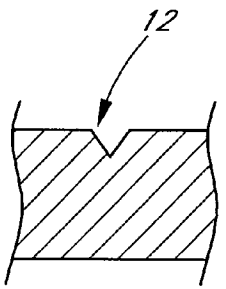
FIGS. 5A-5F are cross-sectional views illustrating different groove configurations for a backerboard.
Figure 5B:
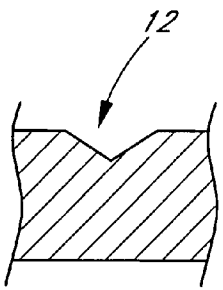
Figure 5C:
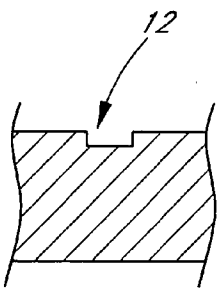
Figure 5D:
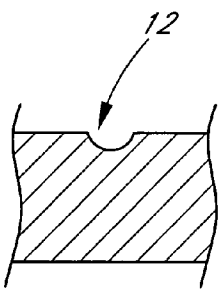
Figure 5E:
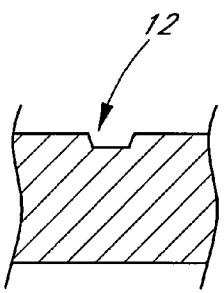
Figure 5F:
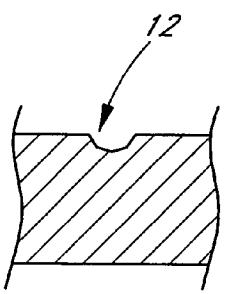

The groove shape is capable of guiding a knife or marker such as a pencil, pen or texture. The cross-sectional shape of the grooves may be square, "V"-shaped, rectangular, semicircular, oval, ellipse, or combinations thereof. FIGS. 5A-5F illustrate several embodiments for groove configurations, which can be V-shaped (FIGS. 5A and 5B), rectangular (FIG. 5C), curved or semicircular (FIG. 5D), trapezoidal (FIG. 5E), or multisided (FIG. 5F). Where a V-shaped cutting knife is to be used, V-shaped groove configurations may be preferable. It will be appreciated that groove configurations other than those described herein are also possible.

Figure 4:
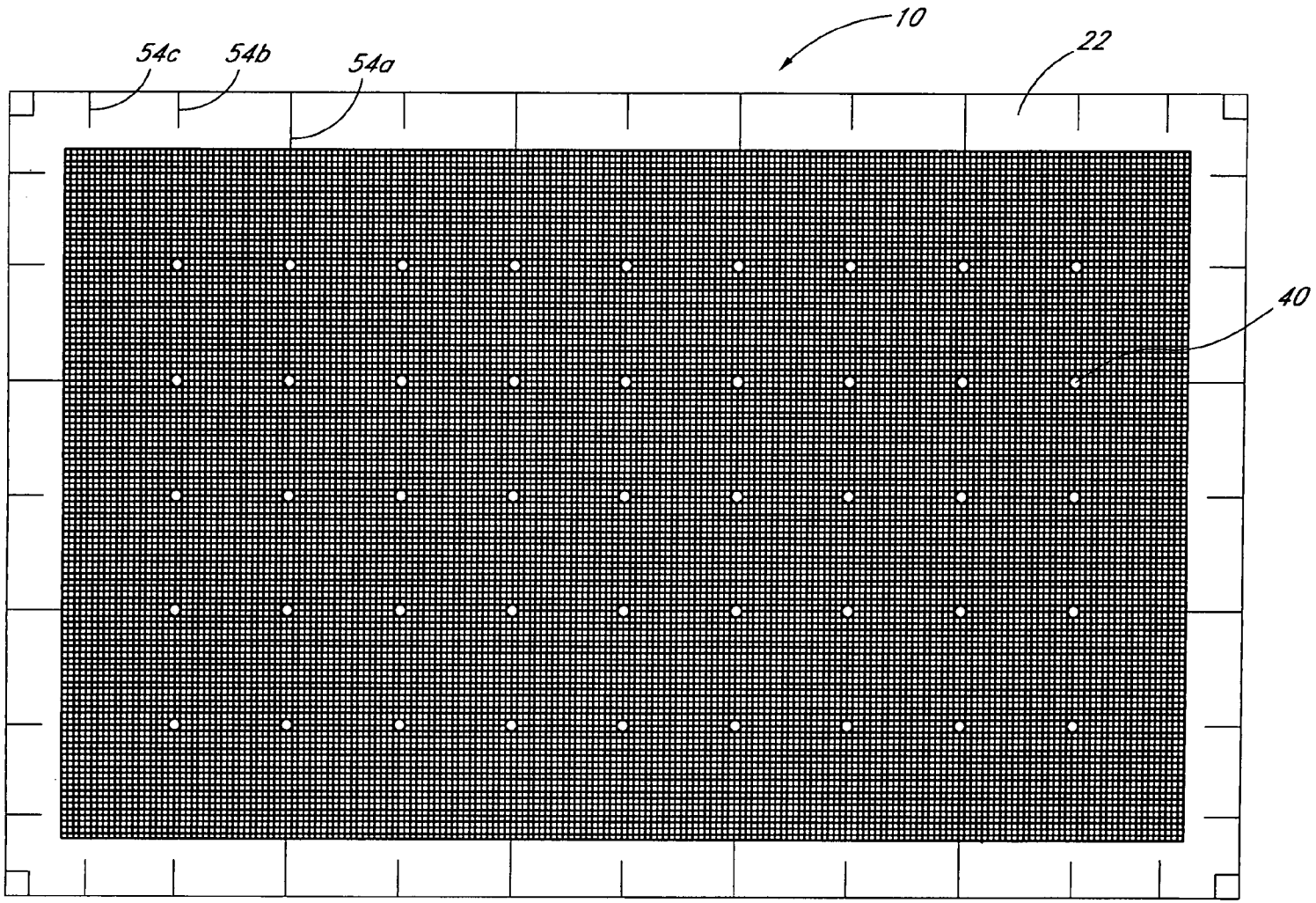
FIG. 4 is a top elevation view of a 3'×5' backerboard having a plurality of intersecting surface grooves with a 3" spacing.
Figure 6:
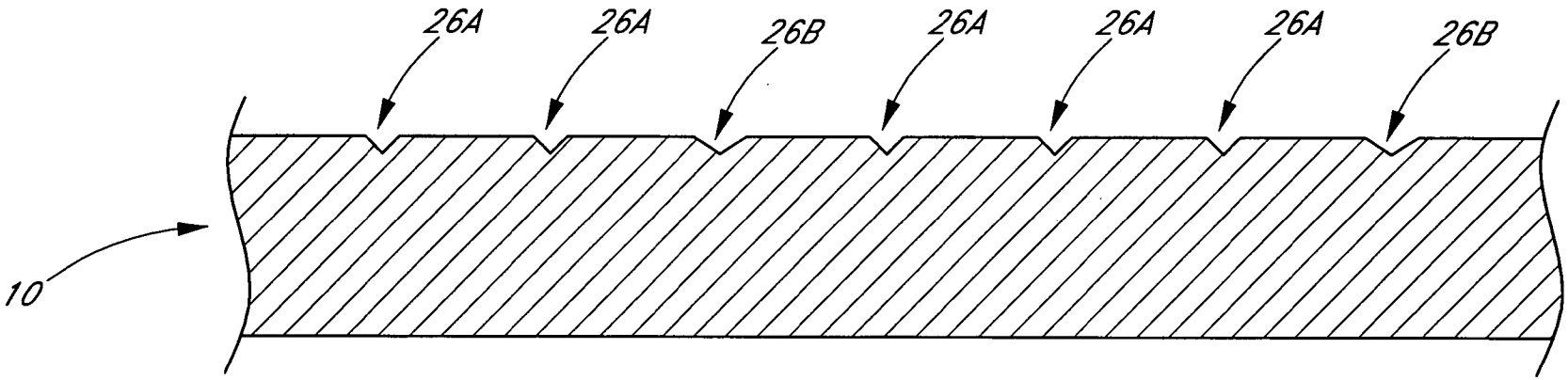
FIG. 6 is a cross-sectional view of a 3" thick backerboard having differentiated V-shaped grooves.

The shape of specific grooves on a backerboard may optionally be different to the general groove design to facilitate easy recognition of incremental dimensions. For example, such a differentiation would enable the recognition of 1 inch increments on a board such as shown in FIG. 4 having a general ¼" increment groove spacing. FIG. 6 illustrates an exemplary differentiation of the groove shape wherein approximately 0.0313" wide by 0.02" deep V-shaped grooves 26*a* are placed at ¼" increments and approximately 0.0625" wide by 0.02" deep V-shaped grooves 26*b* are placed at 1" increments. The wider grooves 26*b* at 1" increments make it easier to distinguish these grooves from the 3" grooves. It will be appreciated that other variations in groove shape, size and incremental spacing are also contemplated. In addition, the differentiation between the grooves can be accomplished by marking or printing in or by selected grooves, as well as through varying the size or shape of the grooves.

Figure 7A:
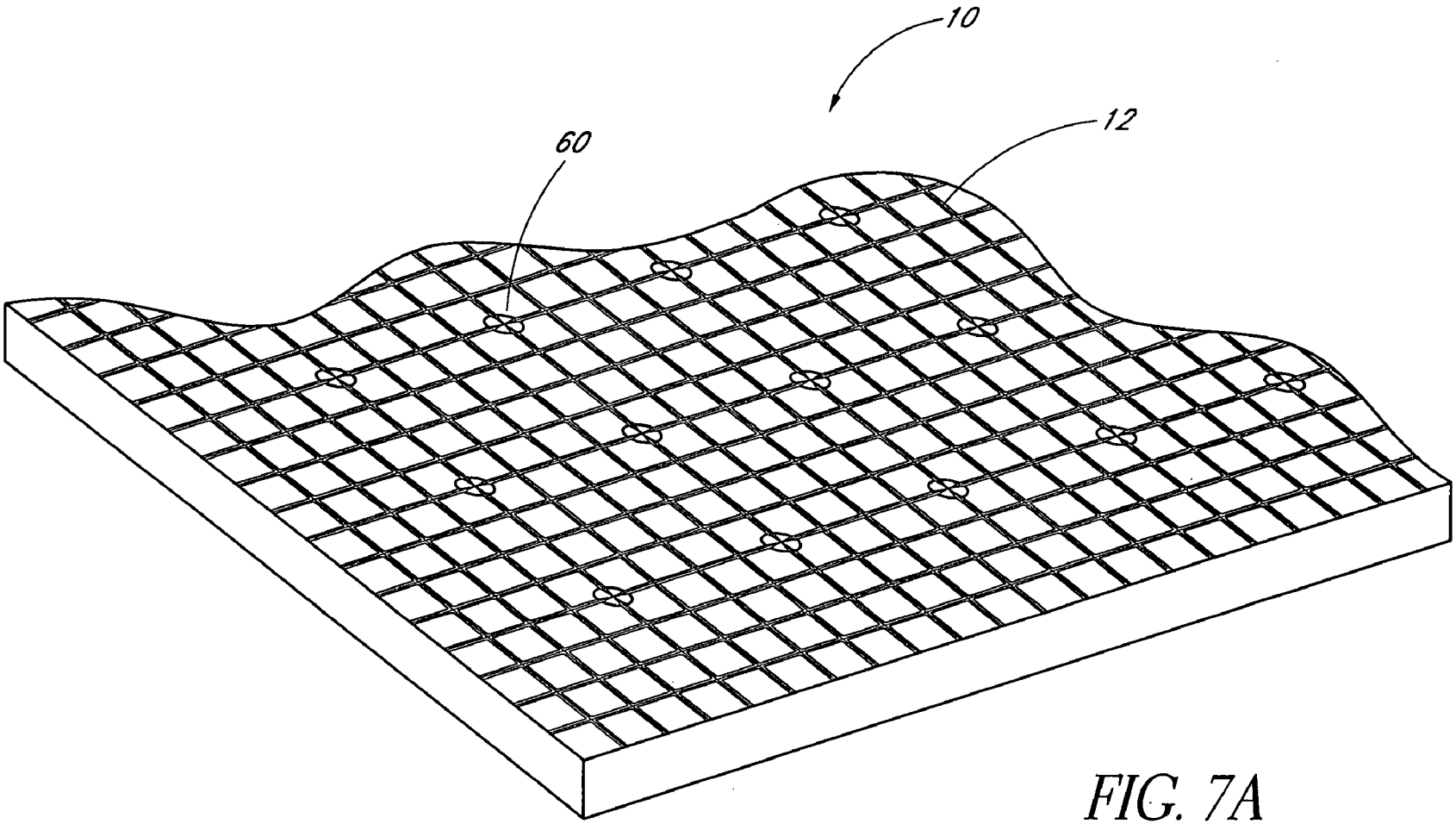
FIG. 7A is a perspective view of a backerboard having circular locators at the intersection of grooves at a 1 inch spacing.
Figure 7B:
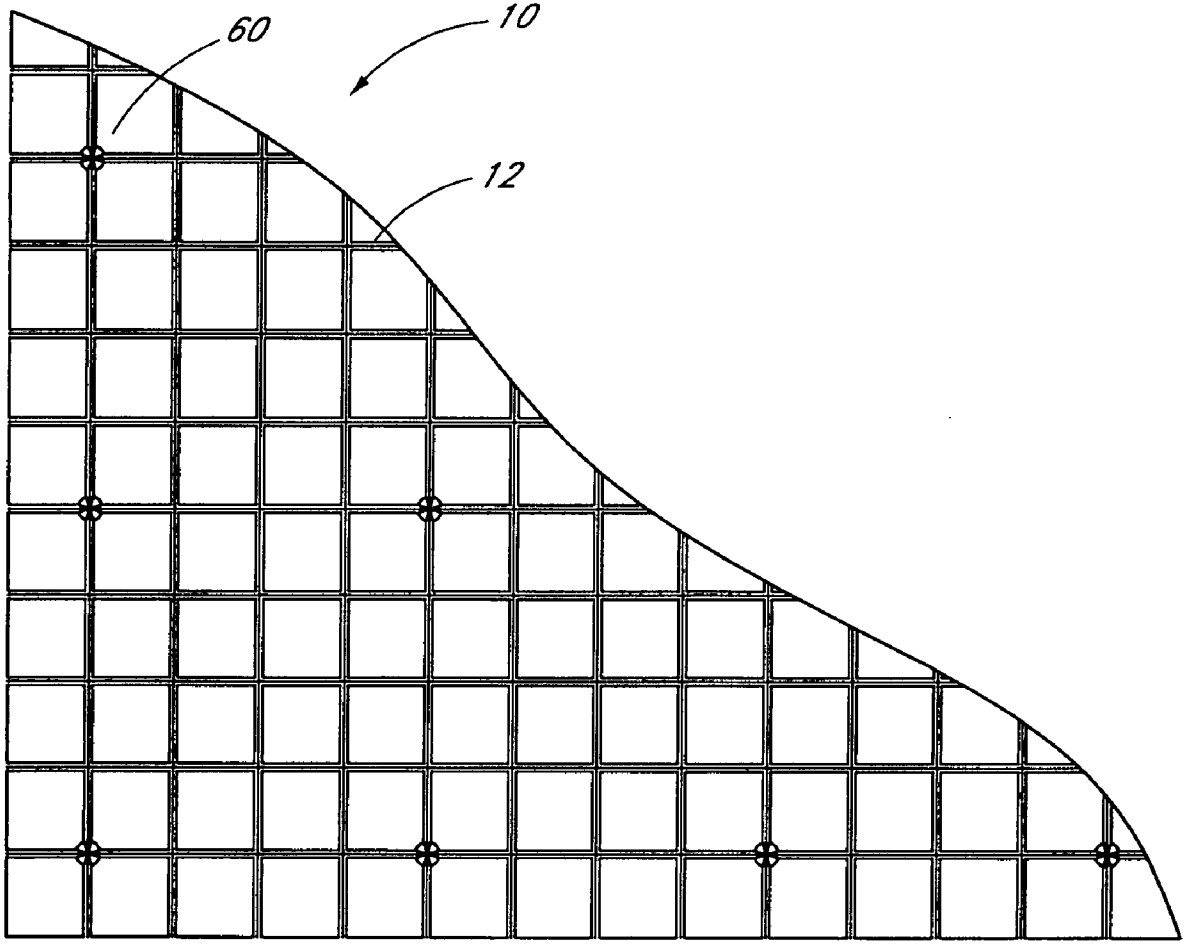
FIG. 7B is a top elevation view of a backerboard having circular locators at the intersection of grooves at a 1 inch spacing.

FIGS. 7A-7B illustrate another embodiment of a backerboard which enableseasy recognition of incremental grove spacing. As shown in FIGS. 7A and 7B, a backboard 10 is provided with evenly spaced parallel grooves 12 intersecting at right angles on the surface of the board. These grooves 12 are preferably V-shaped, and have the same size and shape throughout. In one embodiment, each of the grooves is spaced ¼" apart. To determine a desired spacing between grooves 12, locators 60 are preferably provided at the intersection of certain grooves, more preferably at regularly repeating increments across the board. For instance, in one embodiment, where the grooves are spaced at ¼" increments, the locators 60 are provided at 1 inch increments, and thus at every fourth grove both along the length and width of the board as shown in FIGS. 7A and 7B.

The locators 60 are preferably indented into the surface of the board of the intersection of the grooves. The shape of the locator 60 is preferably generally circular when viewed from above, as shown in FIG. 7B, such that the boundaries of the locator extend outside the lines of the grooves to make the locator more recognizable. In one embodiment, the diameter of the locator 60 is about ¼" as compared to a groove width of about 0.04 inches. The surface of the locator is preferably sloped inward toward the intersection of the grooves to prevent a knife point from accidentally tracking into the locator during cutting. More preferably, the sloping of the surface of the locator makes the shape of the locator generally conical. The depth of the locator is preferably no more than the depth of the grooves, which in one embodiment, is about 0.02".

Figure 8A:
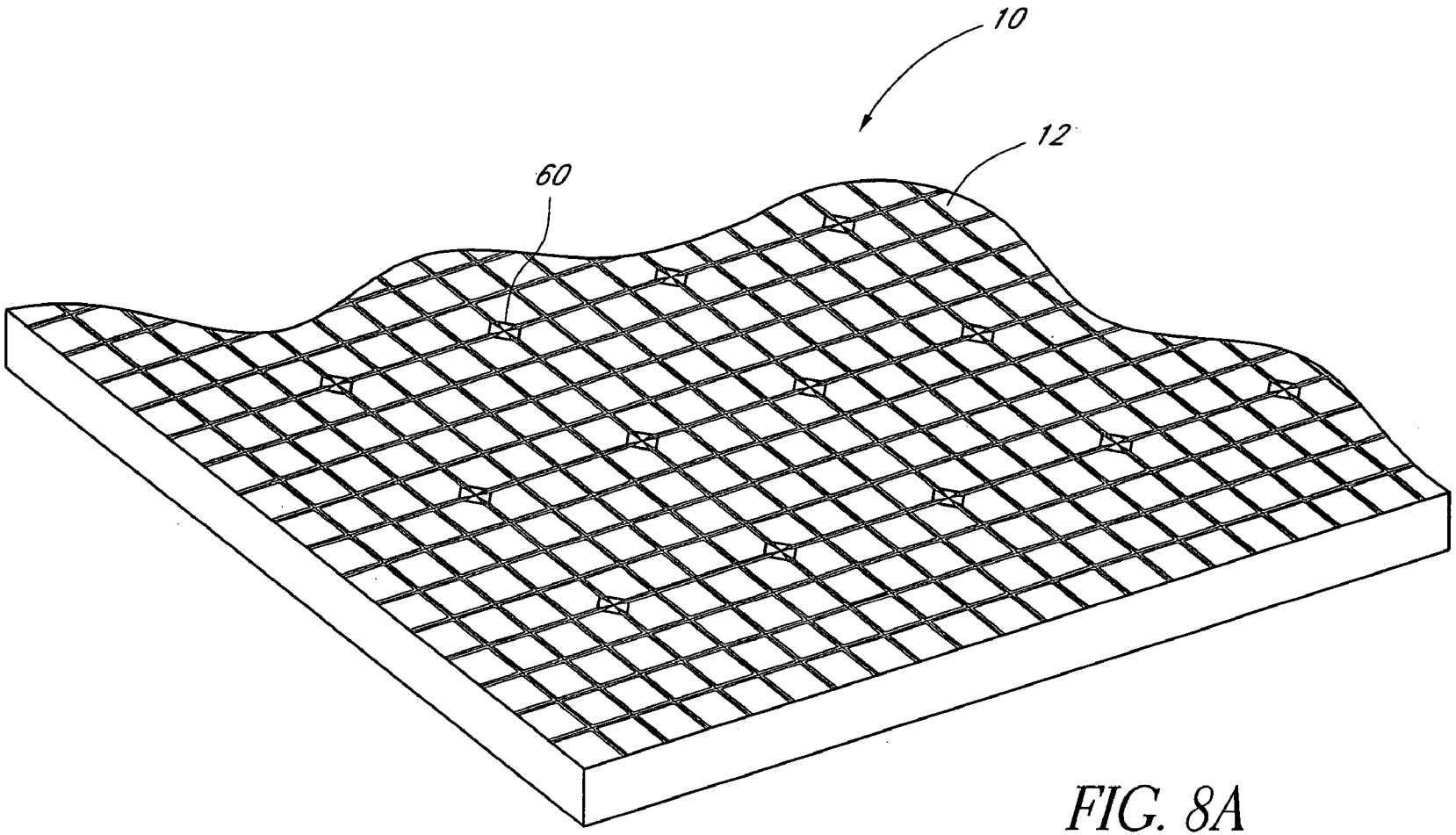
FIG. 8A is a perspective view of a backerboard having diamond-shaped locators at the intersection of grooves at a 1 inch spacing.
Figure 8B:
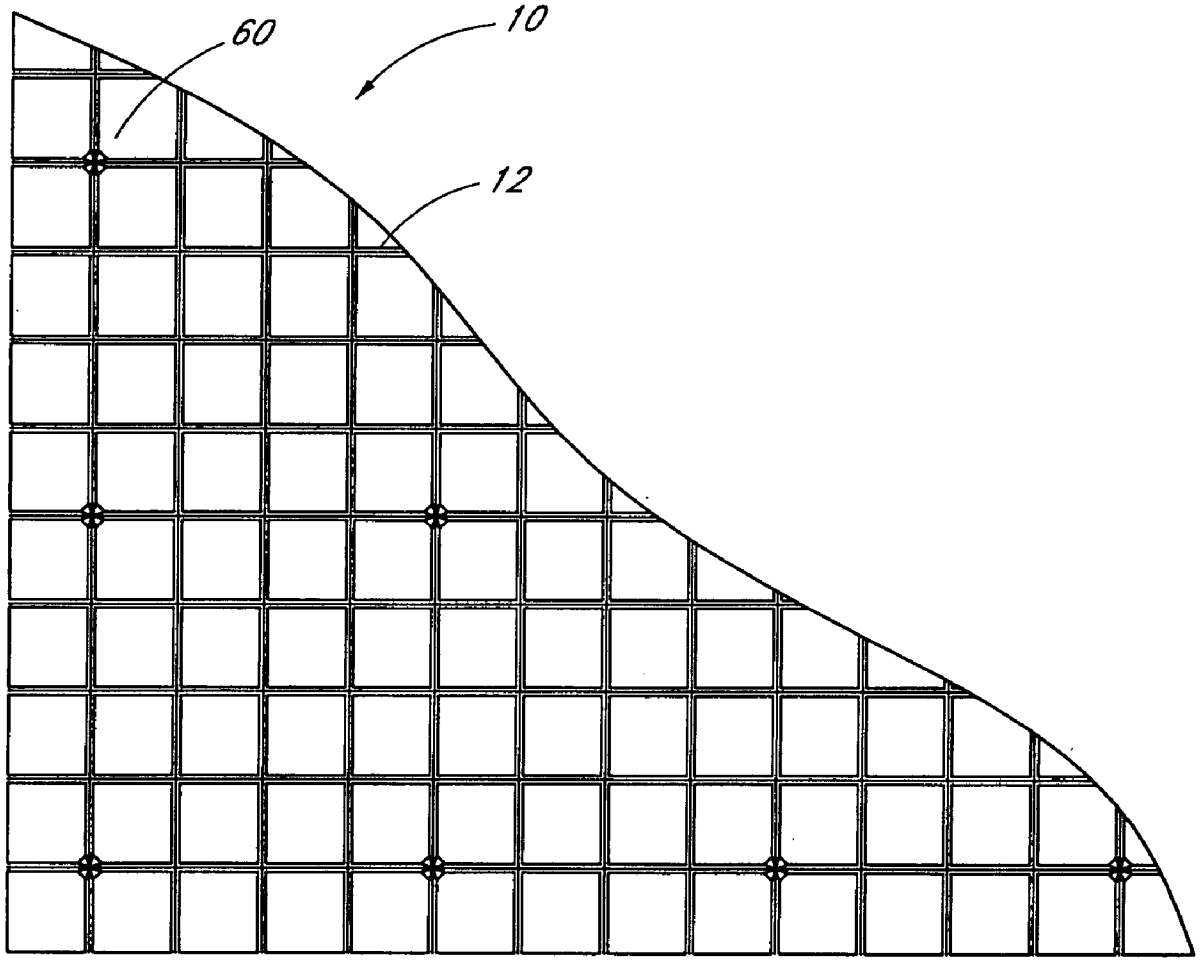
FIG. 8B is a top elevation view of a backerboard having diamond-shaped locators at the intersection of grooves at a 1 inch spacing.

FIGS. 8A-8B illustrate a similar embodiment to that shown in FIGS. 7A-7B, except that the locators 60 have a diamond or square shape rather than a circular shape when viewed from above. The edges of the diamond preferably extend between the perpendicular intersecting grooves, and in the embodiment shown have a length of about 0.03 inches. The locators 60 shown in FIGS. 8A-8B more preferably have sloped surfaces defining a substantially pyramidal shape, with the apex of the pyramid corresponding to the point where the grooves intersect.

It will be appreciated that other shapes may be used to indicate the locators of intersecting grooves on the board. In addition to shapes and indentations, printed indicia can also be used to mark the locations of predetermined intersecting grooves. More generally, any type of locator may be used to mark the location of intersecting grooves at repeating increments across the board, where the increments are determined as a multiple of the standard groove spacing on the board.

Figure 9A:
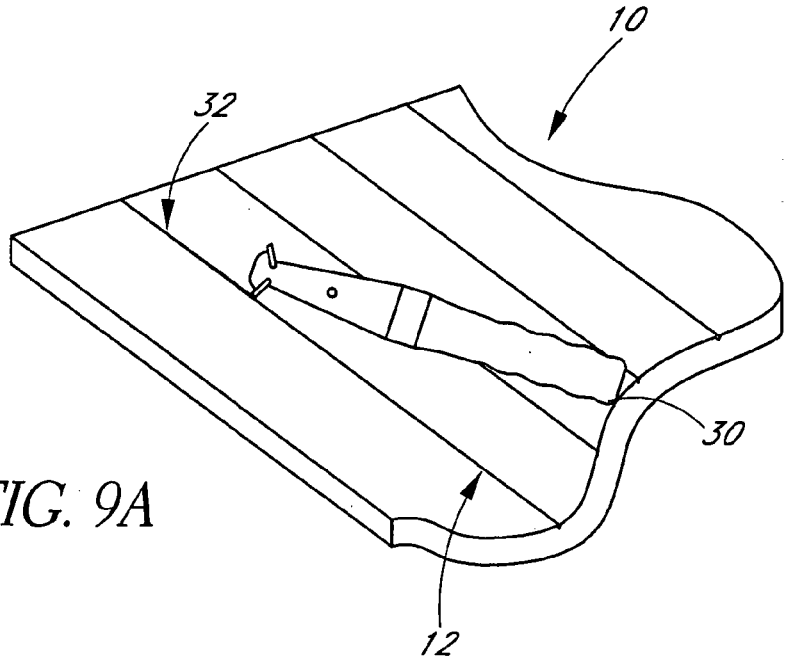
FIGS. 9A is a perspective view of a backerboard having a plurality of parallel grooves indented therein being cut with a scoring knife along the groove.
Figure 9C:
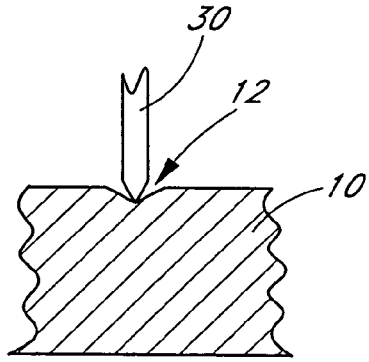
FIG. 9C is an enlarged cross-sectional view of the backerboard of FIG. 9B being cut along a V-shaped groove.
Figure 9B:
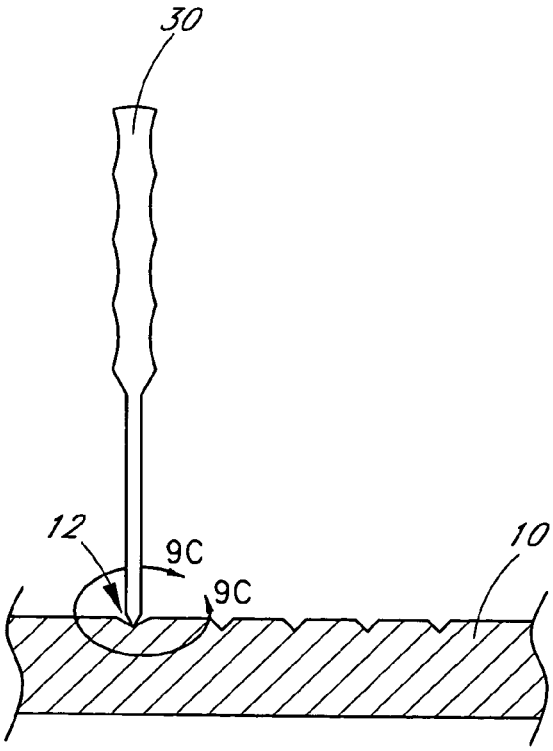
FIG. 9B is a cross-sectional view of the backerboard of FIG. 9A being cut along a V-shaped groove.

FIGS. 9A-9C illustrate one preferred method for cutting a backerboard 10 having at least one groove indented therein. A board 10 having a plurality of parallel grooves 12 is provided. A cutting knife such as a utility knife, more preferably a carbide-tipped score and snap knife 30, cuts the board along one of the grooves. Optionally, a pencil or marker may be used to mark the board along the grooves prior to cutting to indicate the location that the cutting knife or other tool should follow. The groove 12 guides the knife 30 such that a score mark 32 is made across the board within the groove without the need for a straight edge. After scoring the board along the groove, the board is bent along the score mark 32 to break the board.

Cutting and breaking a board in this manner greatly reduces the time, labor and tools required for sizing and installation of the board. The surface groove pattern enables the location of the desired score mark to be easily identified and the corresponding grooves enable a quick and easy score mark to be cut into the sheet so that the sheet can be snapped into the desired size. Thus, there is no need for a tape measure, line marking or straight edge. The only tool that is needed is a score knife that is light and easy to carry in a pocket or tool belt.

Figure 10:
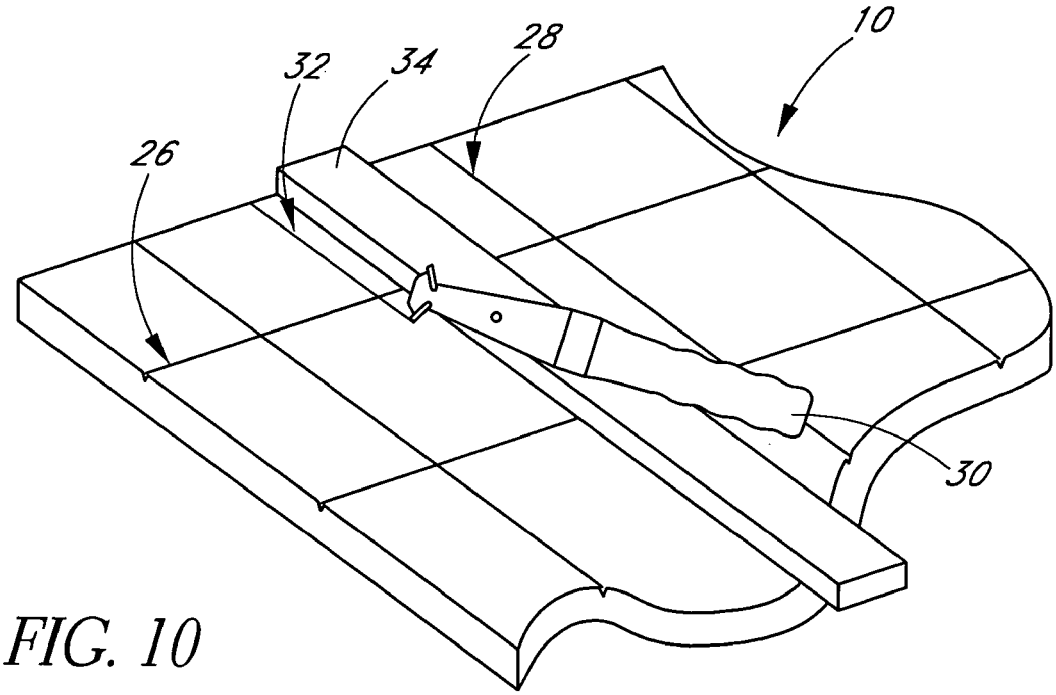
FIG. 10 is a perspective view of a backerboard having a plurality of grooves indented therein and a scoring knife cutting the board between the grooves.

As discussed above, the depth of the grooves is preferably selected so as not to substantially decrease the strength of the backerboard. The reduction in strength of the board due to the presence of grooves can generally be determined, for example, by scoring the board at a location away from a groove, such as the flat region between grooves or across grooves, or diagonally across the line of the grooves. When bending the board to break it, the board should break along the scored mark, and not along any of the grooves. Thus, FIG. 10 illustrates cutting a board in an alternative manner, in which a board 10 has a plurality of grooves 26 and 28 as described above. However, the scoring knife 30 is used to make a score mark 32 between grooves 28 and across grooves 26. This score mark may be made with the assistance of a straight edge 34 as shown, or may also be made freehand or with another tool.

Because of the preferred specially selected depth of the grooves 26, scoring the board across grooves 26 does not cause the score mark to accidentally track into the grooves. This remains true even when the score mark is made at an angle other than 90° to the groove lines, because the depth of the score mark is preferably deeper than the depth of the grooves. For example, the depth of the score mark may be between about 0.8 mm and 1.2 mm. When this board 10 is bent in order to break it, the board will break along the score mark and not along any of the grooves 26 or 28. Thus, it will be appreciated that one particular advantage of the preferred embodiments of the present invention is that the grooved backerboard need not be cut along the grooves, and therefore the cut board is not limited in size or shape to the arrangement of the grooves. The grooves act as a guide only and is not a limitation of the cutting method.

Testing has been performed to demonstrate that formation of the grooves on the board does not decrease substantially the bending strength of the board. A flat, single fiber cement sheet having a thickness of 6.7±0.2 mm was formed having regions with 0.02 inch deep grooves and regions without grooves. The sheets were cut into 250 mm×250 mm test specimens and equilibrated at 50±5% humidity and 73±4° F. The sheets were tested for bending strength using a three point bend test supported over a 165 mm span on a MTS mechanical testing machine. Ten specimens were tested, with the average results given below.

TABLE 1

Peak Loads of Grooved and Flat Backerboard

| | Grooved Surface Strength (Newtons) | Flat Surface Strength (Newtons) |
|---|---|---|
| Face Up | 667 | 700 |
| Face Down | 706 | 741 |

The results of this testing indicate that the strength of the board is not reduced by more than about 5% because of the grooves as compared to a flat surface backerboard. It will be appreciated that shallower or deeper groove depths will cause various reductions of the strength of a board. Thus, even boards that experience a greater reduction in the board's load carrying capacity, for example, up to about 10% and even up to about 20% because of the presence of the grooves are still considered to be useful and within the scope of the invention. More generally, it will be appreciated that boards having grooves indented thereon remain useful so long as the diminished load carrying capacity of the board does not make it difficult to make diagonal or off-groove cuts, or where it becomes difficult to handle the board without the board breaking.

The various groove shapes and sizes are preferably formed by processes such as machining, molding and embossing. Machining includes all wood and metal machining tools such as planers, routers, double end tendon machines, drills, lathes, spindle molders, circular saws, milling machines, etc. Molding the shapes in the material surface can be done during formation of an article in a flat casting mold or on an accumulation roller. Also casting, extrusion, injection-molding processes can also be used. Embossing the shapes in the material surface can be done after the material has been formed but preferably when the article is in a green state (plastic state prior to hardening). The embossing can be done by a patterned roller or plate being pressed into the surface or the sheet. Laser etching may also be used to form the grooves in the sheet.

More preferably, a patterned accumulator roll of a Hatschek process and a roll embossing process have been used to, form the grooves in fiber cement board. In the embossing process, approximately 2,000 to 4,000 pounds per linear foot are required to emboss the grooves onto the green article.

It is an advantage of the accumulator roll formation process that a diagonal score and snap cut at an angle to the grooves is not hindered by the break line unintentionally tracking off to the line of the grooves. This is because the laminate formation of the material is not broken unlike a material post-cure machined groove. More particularly, the accumulator roll process compresses the laminate formation in the grooved region, thereby increasing the localized density around the groove, whereas a machining or cutting process to form the grooves tends to create defects which can lead to crack propagation and even breakage during handling. Thus, a board having grooves formed by the accumulator roll process exhibits greater bending strength than a similar board with grooves formed by machining.

Figure 11:
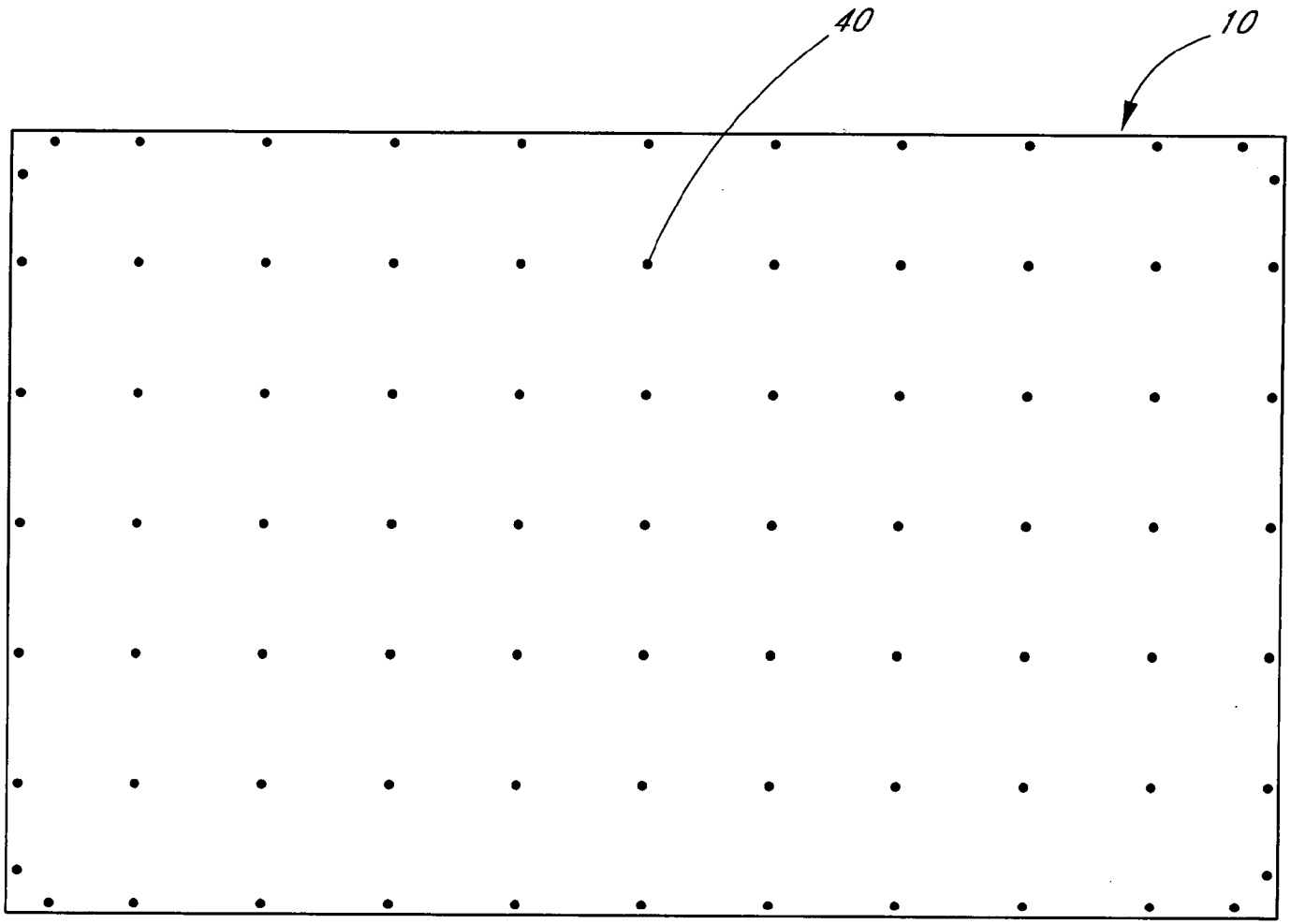
FIG. 11 is a top elevation view of a backerboard having a plurality of fastener indent areas.

Optionally, the backerboard embodiments illustrated in FIGS. 1-4 above also include guide patterns 40 which are used to indicate locations where fasteners such as nails can be placed to fasten the backerboard to underlying materials such as plywood. These guide patterns may be optionally formed or imprinted onto the face of the sheet as a guide for nail fastening, or may be indented below the surface of the board. Nail patterns, for instance, may be provided in boards having grooves, such as shown in FIGS. 1-4, or without grooves, as shown in FIG. 11. When provided on a board having grooves, such as in FIGS. 1-4, the nail patterns 40 preferably intersect the grooves and are spaced apart by a unit measurement (for instance, 6" in FIGS. 2-4). It will be appreciated that nail patterns 40 can also be provided with other spacing, and also between grooves on the backerboard.

In one preferred embodiment, the nail patterns 40 are indentations in the surface of the board to form nail guide indents. For a ¼" board, the depth of the nail guide indents is preferably between about 0.005 inches and ¾ the sheet thickness. More preferably, when the nail guide indents intersect with the grooves on the board, the depth of the indents is at least as deep as the grooves so as not to interfere with the scoring of the board through the grooves. In one embodiment, where the grooves are 0.02" deep, the nail guide indents are 0.04" deep.

Figure 12:
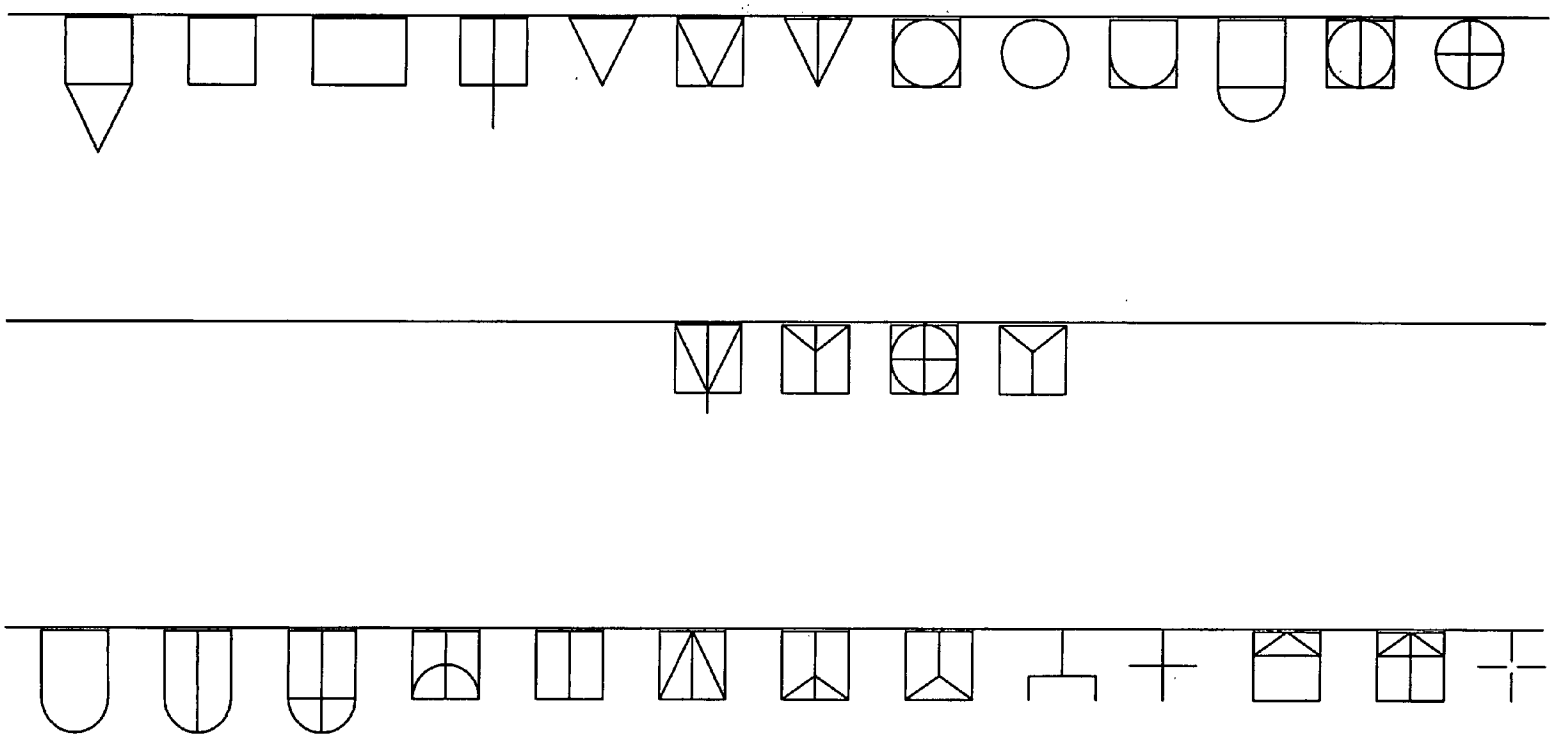
FIG. 12 is a top elevation view of a plurality of imprint or indent patterns that may be used as edge markers or fastener guides.

FIGS. 1-4 and 11 illustrate the nail guide pattern as being a circle. The diameter of the circle is preferably large enough to at least accommodate the head of the fastener to be inserted therein. As shown in the embodiment of FIG. 4, this circle preferably has a diameter of 0.25 to 1 inch, more preferably about 0.45". It will be appreciated that, whether the pattern is an imprint or is indented into the surface of the board, the pattern may have other shapes, such as a round or oval dot, a short line, a broken line, an intersection set of short lines, a circle, a semicircle, a triangle, a square, a rectangle, or a polygon. A variety of possible patterns are shown in FIG. 12, described in further detail below.

Figure 13A:
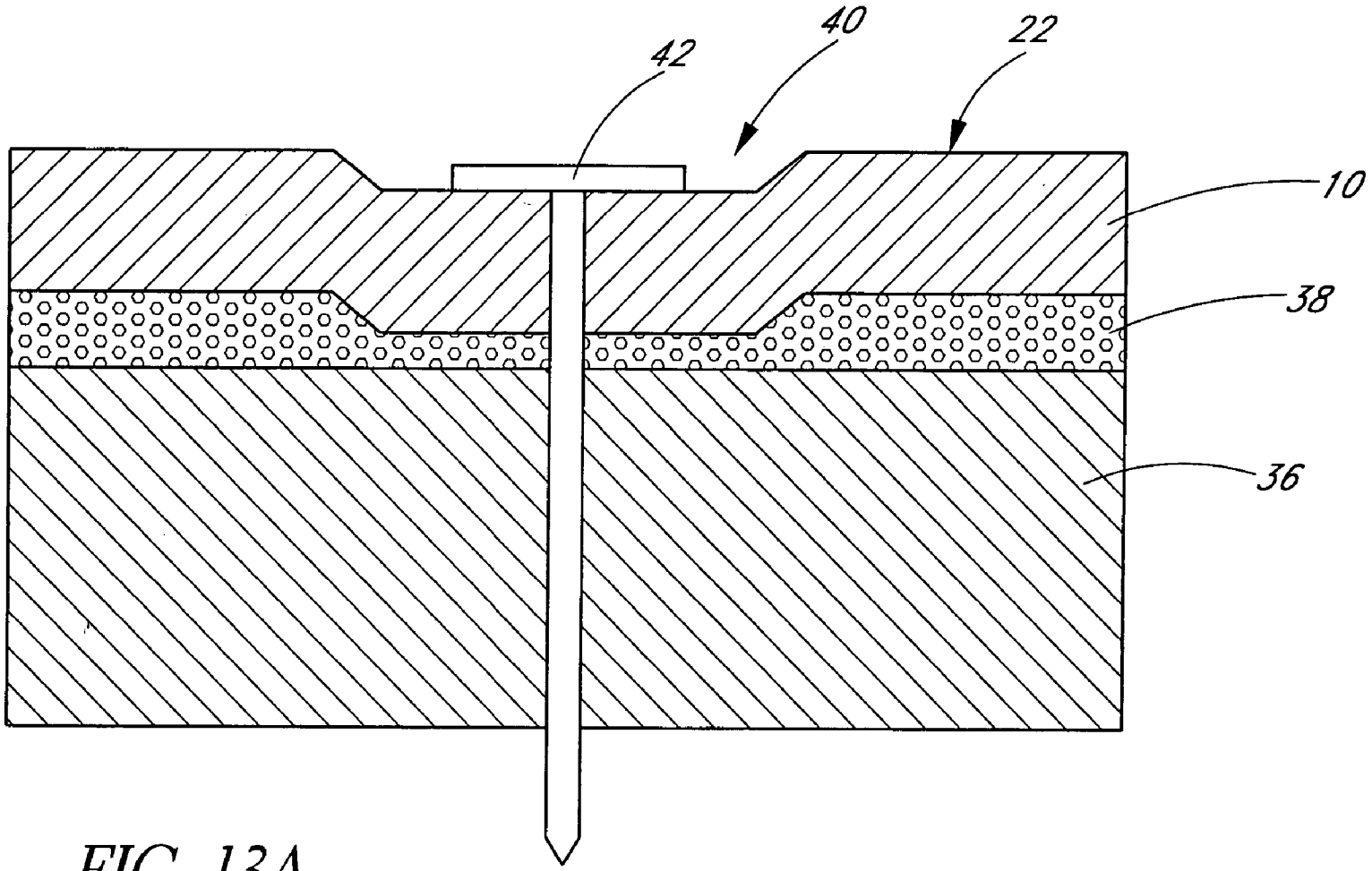
FIGS. 13A and 13B are cross-sectional views of a backerboard having fastener indent areas.
Figure 13B:
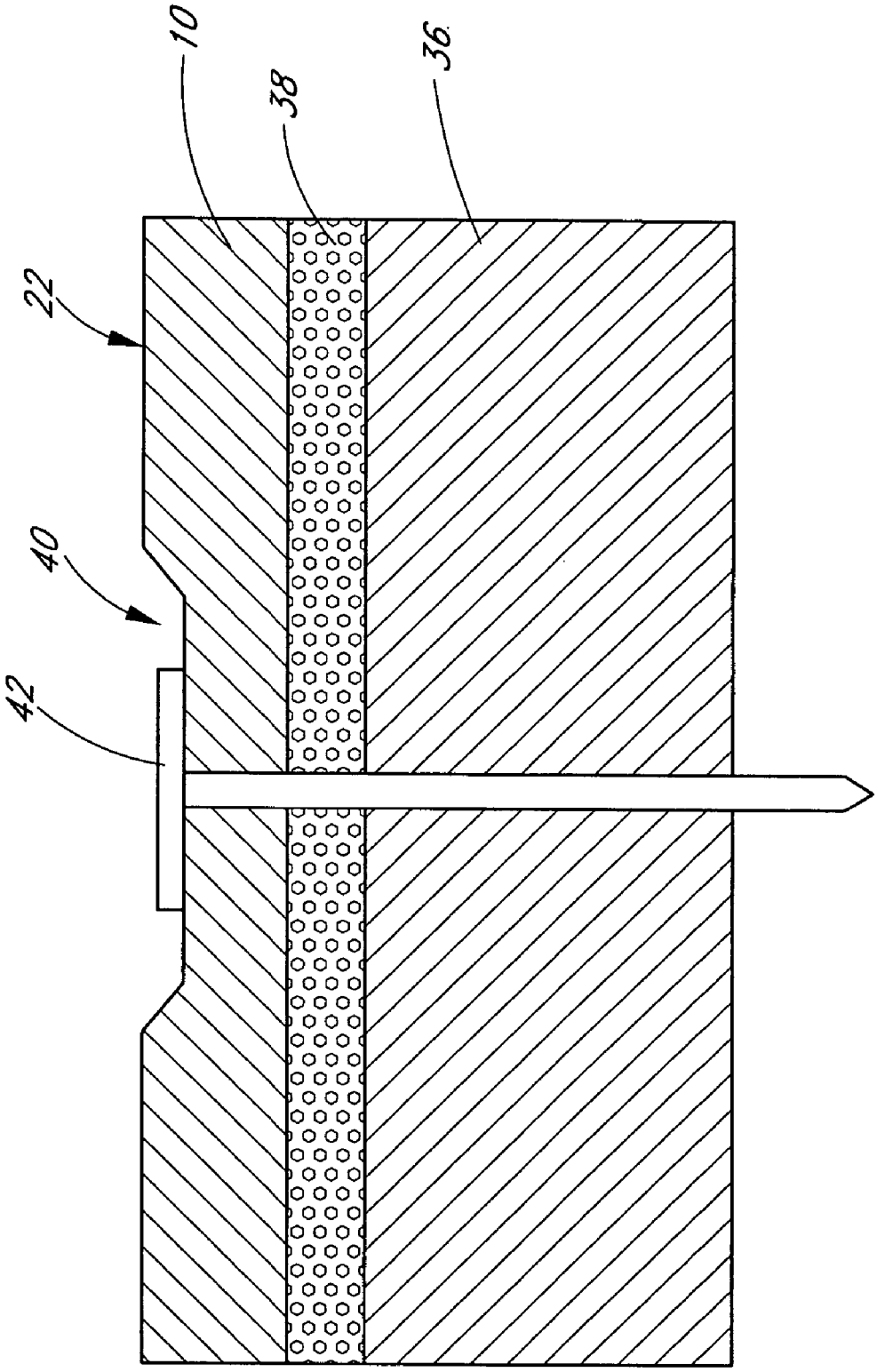

When the nail guide pattern is an indentation formed into the surface of the material, the shape and size of the indentation shall be preferably sufficient to accommodate the head of the nail below the main surface of the material. FIG. 13A illustrates one embodiment of a ¼" backerboard 10 fastened to a plywood flooring 36 using an adhesive, such as portland cement mortar thinset 38. A fastener or nail indent area 40 is provided on the top surface 22 of the backerboard for receiving fastener or nail 42, which is preferably a 1¼" corrosion resistant roofing nail. The nail indent area 40 is an indentation defining a set down area extending below the top surface 22 such that the head of the nail 42, when driven through the backerboard into the plywood, does not extend above the top surface 22. In the embodiment shown in FIG. 13A, the bottom surface 24 of the backerboard 10 also has a close to corresponding set down area 44 below the nail indent area 40 when formed using a Hatschek or similar process. Alternatively, the bottom surface 24 may be completely flat, as in FIG. 11B, such as when the indentation is formed by a machining or an embossing process.

The nail guides 40 illustrated in FIGS. 1-4 and 11 provide locations for nails in a regularly spaced arrangement around the board 10. However, near the edges of the board, the nail guides 40 are preferably placed slightly inward of the edge to accommodate fastening near the edges. As illustrated in FIG. 2, for nail guides 40 generally spaced 6" apart in a 3'×5' board, near the edges of the board the nail guides 40 are preferably placed 2" from the edges. More particularly, near the corners of the board the guides 40 are placed 2" from one edge and 2" from the other. It will be appreciated that these dimensions are purely exemplary, and therefore, other nail guide spacing may also be used.

Figure 14:
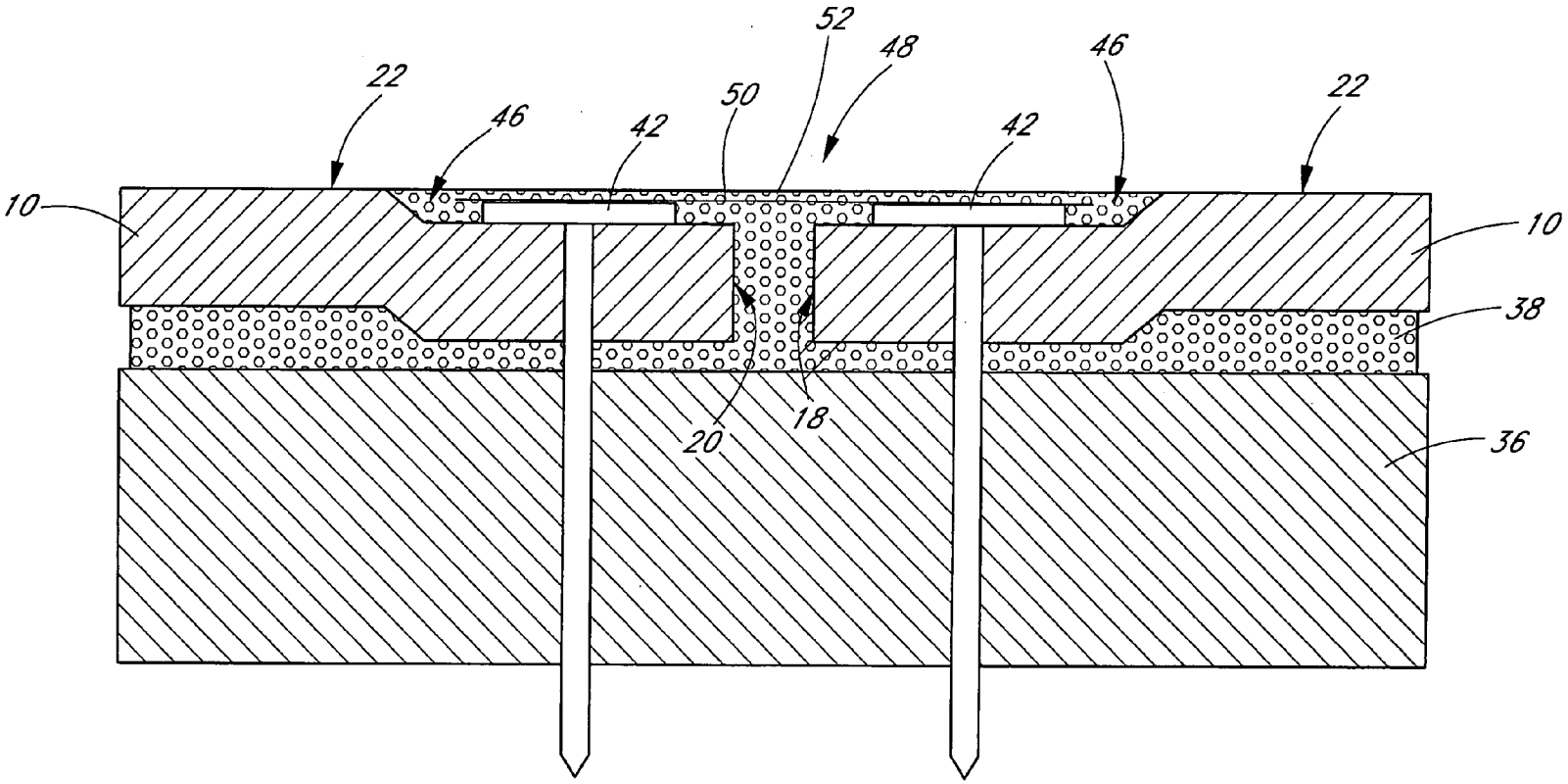
FIG. 14 is a cross-sectional view of one embodiment of a pair of backerboards having a set down area fastened to a plywood flooring.

FIG. 14 illustrates another optional embodiment in which the edges of the board have a set down area to accommodate nails, adhesive and alkali resistant fiberglass reinforcing tape found at the joint of two boards. When laying two backerboards adjacent each other, adhesive tape is often used to tape the joint along the edges of the adjacent backerboard. FIG. 14 illustrates such a joint 48 between two adjacent backerboards 10*a* and 10*b* fastened to plywood flooring 36 through adhesive 38. Near the edges 20 and 18 of backerboards 10*a* and 10*b*, respectively, nails 42 are driven through the backerboards to fasten the boards to the plywood 36. Reinforcing tape, such as an alkali resistant fiberglass backer tape 50, is placed over the head of the nails to join the boards together.

Figure 15A:
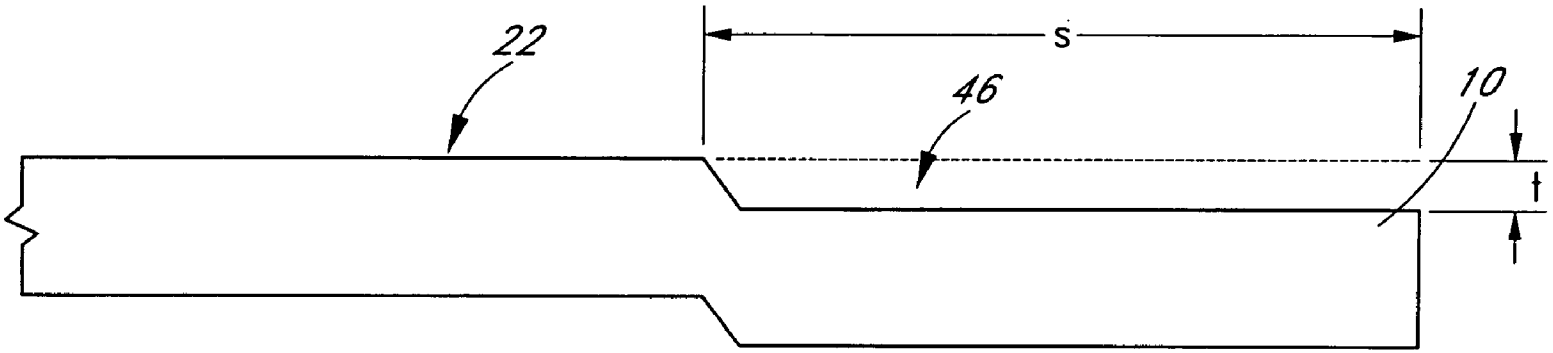
FIG. 15A is a side view of one embodiment a backerboard having a set down area on both its front surface and its back surface.
Figure 15B:
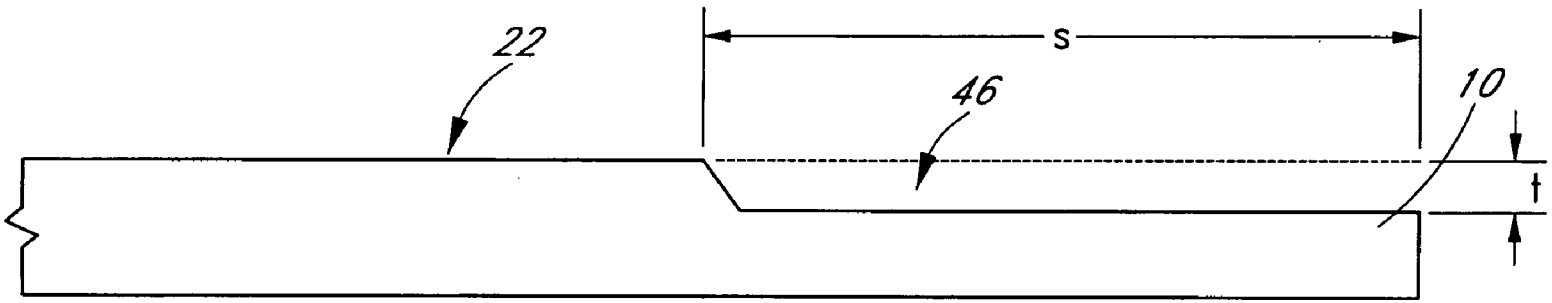
FIG. 15B is a side view of another embodiment of a backerboard having a set down area on its front face only.

The backerboards 10*a* and 10*b* each preferably has an edge set down area 46 on the front surface 22 thereof at the edge near the joint 48, where the front face 22 of the boards is recessed or set down by a distance t, illustrated in FIGS. 15A and 15B. This set down area 46 provides a location for setting the backerboard, using nails 42 as described above driven through the board into the plywood 36. Because of the set down area, the heads of the nails do not extend above the surface 22. In addition, the reinforcing tape 50 provided over the joint and over the nails 46 is completely within the set down area 46 and does not rise above surface 22. As shown in FIG. 14, the set down area 42 is preferably filled with portland cement mortar thinset 52 or other adhesive to provide a flat surface for the adhesion of tile or other building products. The set down thus has the advantage of providing a space for joint setting compounds, fasteners and reinforcing fabrics to fill to a level flat with the surface of the main sheet while enabling the strengthening of the connection between two sheets.

In the embodiment of FIGS. 14-15B, the plywood flooring 36 preferably has a thickness of about ¾", and the backerboards 10*a* and 10*b* each has a thickness of about ¼". The nails 42 are preferably about 1¼" in length, and the backer tape 50 is about 2" wide. The width s of the set down from the edge of the sheet shall be sufficient to accommodate reinforcing tape in the joint between two sheets are placed alongside each other. When the reinforcing tape is about 2 inches wide, the set down width is preferably greater than half this width, about 1 inch. Preferably, the widths of the edge set down is about 1.25 inches to allow for clearances. The width may be designed in other ways to suit the reinforcing tape width.

The depth t of the set down is preferably sufficient to accommodate a flat head fastener, such as a roofing nail or a bugle-head screw, plus reinforcing tape and joint setting compounds such that the joint can be set flat with the main flat surface of the sheet. Preferably, a set down t of about 0.04 inches is used, and more preferably is not less than about 0.005 inches and not greater than about ¾ the thickness of a ¼" sheet. An advantage of this design is that nail or screw heads are accommodated by lower regions to ensure that the surface flatness is not interrupted by high points that may act as stress concentrators when loaded in application. The set down area also helps ensure that the nail is not overdriven into the material such that the nail's sheet pull through strength is reduced.

The embodiment illustrated in FIG. 14 depicts the backerboards 10*a* and 10*b* as having a bottom surface also having a set down depth. Alternatively, a board with this type of construction is also shown in FIG. 15A. FIG. 15B illustrates a similar board wherein the bottom surface 24 is completely flat.

It will be appreciated that in boards having an edge set down area, the grooves may or may not extend into this area because of the recessed depth of the area. The edge set down area may also be used for edge markers, as described below.

The nail guide indentations and other set downs may be formed into the boards by many processes such as forming the set down during formation of the sheet, using an accumulator roll, embossing the set down into the green-sheet or machining the set down out of the surface of the building sheet. These and other methods have been described above with respect to forming the grooves.

In another embodiment, accurate sizing of the board may further be assisted by providing edge markers on the surface of the board adjacent the grooves. These edge markers are preferably formed into the face of the sheet near the edges to indicate incremental distances or measurements. Furthermore, where the board has edge set down areas as described above, these edge markers may be provided in the set down areas. FIG. 12 illustrates several embodiments for marker shapes. As illustrated, the edge marker pattern can be an imprint or formed groove or indent in the shape of a round or oval dot, a short line, broken line, intersection set of short lines, circle, semicircle, triangle, square, rectangle, polygon, combinations thereof, or other shapes, characters or indicia. Edge markers may also be indented numbers to indicate certain increments.

Edge markers preferably designate a particular increment of distance, usually a multiple of the smallest increment, the smallest increment preferably being the distance between adjacent grooves. The marker is preferably formed to have the full shape formed into the surface of the board such that the surface of the marker shape is slightly lower than the surrounding sheet surface. Grooves as described above may extend all the way across the sheet to the edges through the markers, or may stop short of the edge markers.

In a preferred embodiment, FIG. 4 illustrates a backerboard 10 having edge markers indented into the top surface 22. Edge markers 54*a* and 54*b* as shown are provided at generally 6" increments for the 3'×5' backboard, although it will be appreciated that other increments, such as 1 inch or 12 inches, may also be used. The markers are preferably straight lines extending inward from the edges of the board. The markers are preferably indented below surface 22, more preferably 0.04" deep for a ¼" board. FIG. 4 also illustrates that different edge markers may be used around the board. Thus, as illustrated, longer line markers 54 a are provided at a 1' spacing around the board, while shorter line markers 54*b* are provided between the markers 54*a* at a 6" spacing. Near the corners of the boards markers 54*c* are provided to designate the minimum distance to the corners for nailing, which is typically about 2 inches. It will be appreciated that this marker shape and arrangement is purely exemplary, and thus other markers in different arrangements may be used to indicate measurement units on the board.

One particular advantage of the indentations described above, including the grooves, locators, nail indents, edge marker indents, set down areas, etc. is that these indentations provide a mechanical keying effect and increased surface area for bonding with an overlying material, such as ceramic tile. The indentations are thus capable of receiving adhesive therein. The greater contact area of the adhesive and the grooves' and other indentations' shape in the surface provides increased thinset/backer connection strength against tensile and shear forces.

Moreover, because in several embodiments the building sheet is used as an underlay layer, the grooves do not affect the utility of the material. This is significant because for many applications, grooves cannot be made in the face because the face must remain flat to obtain a smooth finished surface for painting typical of most interior wall finishes and/or other reasons. In one embodiment, the backerboards described herein need not have flat faces because these faces are used to adhere other materials. Moreover, even when a building sheet with a completely flat surface is desired, the principles taught herein may be used to indent grooves and/or other indentations on the other side of the sheet.

Generally, the above-described embodiments provide for quick and easy installation of a building sheet material by providing incremental visual reference for measuring the desired sheet-cutting pattern, then marking and cutting out the building sheet using an indented pattern or score guide in the surface of the sheet as a guide. The score guide makes the installation quicker and easier because fewer if any measured markings need to be made on the sheet. An indent pattern in the face of a sheet can be used as a guide for a score knife without requiring a straight edge to guide the cut or as a guide for a pencil or marker to mark the layout of the cut without requiring a straight edge to mark the cut layout. An indent pattern may also be provided to indicate appropriate nailing locations and desired cutting locations. The process involves forming an indented pattern into the surface of the material that provides a guide for cutting the sheets to size for installation. The pattern may be formed off a molded pattern or pressed or embossed or laser cut or machined into the surface of fiber cement sheet to produce a pattern of small straight grooves that provide a guide for measurement and cutting when installing sheet building material. Application of this invention is particularly advantageous to, but not limited to, the installation of cement-based building sheets, such as cement-based tile backer board.

General practice during installation of backerboard requires cutting sheets to fit over a floor or other area in a brick pattern layout. The cut-outs in a sheet are most commonly parallel or perpendicular to the sheet edges of the sheet. The pattern of grooves in the face of the sheet are parallel and perpendicular with the sheet edges. Considerable time and effort is therefore saved in not having to mark out two measurements for parallel nor require a straight edge to join the marks to form a line of cut. Furthermore, a straight edge or Plasterer's "T"-square device of sufficient stiffness to guide the knife is not required because the grooves guide the tip of the knife. Since no straight edge tool is require to guide or mark most of the cuts, fewer tools are needed to be located or moved around as part of the installation procedure, therefore speeding up the installation time and improving the ease of installation.

The embodiments illustrated and described above are provided merely as examples of certain preferred embodiments of the present invention. Various changes and modifications can be made from the embodiments presented herein by those skilled in the art without departure from the spirit and scope of the invention, as defined by the appended claims.

What is claimed is:

1. A building sheet, comprising:

a fiber cement board having a front surface and a back surface, said front and back surfaces defining a thickness of said board; and a plurality of guide patterns provided on one of said front surface and said back surface to indicate locations where fasteners are to be placed, said guide patterns each having a surface area sized to receive a head of a fastener thereon, wherein said guide pattern is indented into said fiber cement board without piercing through said board.

2. The building sheet of claim 1, wherein said surface area of each guide pattern is generally greater than a surface area of a head of a fastener that extends through said fiber cement board.

3. The building sheet of claim 1, wherein the fiber cement board comprises:

between about 20% to about 60% cement;

between about 20% to about 70% silica; and less than about 12% cellulose fibers.

4. The building sheet of claim 1, wherein said guide patterns comprise an array of discrete fastener guides arranged in regularly repeating patterns across said board.

5. The building sheet of claim 1, wherein said board is backerboard.

6. The building sheet of claim 1, wherein said board is a panel.

7. The building sheet of claim 1, wherein the guide patterns are circular.

8. The building sheet of claim 7, wherein the guide patterns have a diameter of about 0.25 inches to about 1 inch.

9. The building sheet of claim 1, further comprising a plurality of fasteners extending through said guide patterns on said board.

10. The building sheet of claim 1, where portions of the board forming the plurality of guide patterns are generally flat.

11. The building sheet of claim 1, wherein said front surface and back surface each have flat portions that define a front plane and back plane, respectively, and the entire fiber cement board is confined between the front plane and the back plane.

12. The building sheet of claim 1, wherein the surface areas of the guide patterns each are configured to be penetrated by said fastener.

13. A building sheet, comprising:

a fiber cement board having a front surface and a back surface, said front and back surfaces defining a thickness of said board; and a plurality of nailing indicators provided on said front surface, said nailing indicators indicating locations where nails are to be placed, said nailing indicators each being sized and configured to circumscribe a head of a nail thereon, wherein the nailing indicators each have a generally flat surface indented into said fiber cement board without piercing through said board and configured to engage a head of a nail.

14. The building sheet of claim 13, wherein the nailing indicators each are printed indicia on said front surface of said board.

15. The building sheet of claim 13, wherein the nailing indicators each are configured to be penetrated by a nail.

16. A building sheet, comprising:

a fiber cement board having a front surface and a back surface, said front and back surfaces defining a thickness of said board;

a plurality of nailing indicators provided on said front surface, the nailing indicators indicating locations where nails are to be placed, said nailing indicators indented into said fiber cement board without piercing through said board, each being sized and configured to circumscribe a head of a nail thereon; and a foundation layer attached to said board by a plurality of nails which contact said nailing indicators, said nails extending from said nailing indicators through said board.

17. The building sheet construction of claim 16, wherein a perimeter of each of said nailing indicators surrounds a head of a nail engaged with said nailing indicators.

18. A building sheet, comprising:

a fiber cement board having a first surface and a second surface and at least one edge extending along a length of said board; and a fastener area provided on said first surface defining a width extending adjacent said at least one edge along said length of said board, said fastener area being spaced from said at least one edge, said fastening area including at least one nailing indicator being of sufficient size to accommodate a head of a fastener within said nailing indicator, said nailing indicator being indented into said fiber cement board without piercing through said board.

19. The building sheet of claim 18, wherein said at least one nail indicator has a width less than about 1 inch.

20. The building sheet construction of claim 18, wherein said at least one nail indicator has a rectangular shape.

21. The building sheet construction of claim 18, wherein said at least one nail indicator has a width in the range of about 0.25 inches to about 0.45 inches.

22. The building sheet construction of claim 18, wherein said at least one nail indicator has a width less than about 0.45 inches.

23. The building sheet construction of claim 18, wherein said fastener area has a first side and a second side that are generally parallel to one another.

24. The building sheet construction of claim 18, wherein said fastener area extends along substantially the entire said length of said board.

25. The building sheet of claim 18, wherein the fastener area is visually distinctive from other portions of the first surface.

* * * * *